US011802573B2

(12) United States Patent
Numata et al.

(10) Patent No.: US 11,802,573 B2
(45) Date of Patent: Oct. 31, 2023

(54) BLOWER

(71) Applicant: MAKITA CORPORATION, Anjo (JP)

(72) Inventors: Fumitoshi Numata, Anjo (JP); Takumi Hayashi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/556,167

(22) Filed: Dec. 20, 2021

(65) Prior Publication Data

US 2022/0196035 A1 Jun. 23, 2022

(30) Foreign Application Priority Data

Dec. 23, 2020 (JP) ..... 2020-214188
Dec. 23, 2020 (JP) ..... 2020-214190

(51) Int. Cl.
*F04D 25/06* (2006.01)
*F04D 29/52* (2006.01)
(Continued)

(52) U.S. Cl.
CPC ..... *F04D 29/522* (2013.01); *F04D 19/002* (2013.01); *F04D 25/06* (2013.01); *F04D 29/083* (2013.01)

(58) Field of Classification Search
CPC ..... F04D 19/002; F04D 25/06; F04D 29/083; F04D 29/522
See application file for complete search history.

(56) References Cited

U.S. PATENT DOCUMENTS 4,135,080 A * 1/1979 Wells, Jr. ..... A45D 20/08 34/201
4,972,065 A * 11/1990 Ohlsen ..... A45D 20/12 34/97
(Continued)

FOREIGN PATENT DOCUMENTS

JP 2002-310098 A 10/2002
JP 2010-185289 A 8/2010
(Continued)

OTHER PUBLICATIONS

Dec. 6, 2022 Office Action issued in Japanese Patent Application No. 2020-214190.
(Continued)

*Primary Examiner* — Thomas Fink
(74) *Attorney, Agent, or Firm* — Oliff PLC

(57) ABSTRACT

A blower includes a body having a main inlet opening and a discharge opening, a motor assembly housed in the body, and an auxiliary inlet opening. The motor assembly includes a case, a motor and a fan. The case has a first opening and a second opening. The motor is housed within the case. The fan is configured to rotate in response to driving of the motor to generate a flow of air passing the main inlet opening, the first opening, the motor, the second opening and the discharge opening in this order. A first space that communicates with the main inlet opening and the first opening of the case is formed within the body. The auxiliary inlet opening is configured to introduce the air from an outside of the body into the first space.

19 Claims, 17 Drawing Sheets

(51) Int. Cl.
*F04D 29/08* (2006.01)
*F04D 19/00* (2006.01)

(56) References Cited

U.S. PATENT DOCUMENTS

| | | | | |
|---|---|---|---|---|
| 10,905,585 | B1 * | 2/2021 | Sabin | A61M 16/0875 |
| 2014/0050600 | A1 * | 2/2014 | Kodato | A01G 20/47 417/360 |
| 2015/0366424 | A1 * | 12/2015 | Naka | E01H 1/0809 239/590.5 |
| 2016/0213123 | A1 * | 7/2016 | Sakuma | A45D 20/12 |
| 2016/0324292 | A1 * | 11/2016 | Depoyian | A45D 20/50 |
| 2018/0172024 | A1 | 6/2018 | Hayamitsu et al. | |
| 2018/0187687 | A1 * | 7/2018 | Yakubova | F04D 25/08 |
| 2020/0137966 | A1 * | 5/2020 | Suzuki | F04D 29/584 |
| 2022/0032439 | A1 * | 2/2022 | Numata | B08B 13/00 |
| 2022/0196035 | A1 * | 6/2022 | Numata | F04D 17/165 |
| 2022/0305508 | A1 * | 9/2022 | Numata | B05B 7/2429 |

FOREIGN PATENT DOCUMENTS

| | | | |
|---|---|---|---|
| JP | 2011-117442 | A | 6/2011 |
| JP | 2015-34514 | A | 2/2015 |
| JP | 2017-070337 | A | 4/2017 |
| JP | 2017-129111 | A | 7/2017 |
| JP | 2018-84151 | A | 5/2018 |
| JP | 2020-139453 | A | 9/2020 |
| WO | 2016/194254 | A1 | 12/2016 |

OTHER PUBLICATIONS

Apr. 4, 2023 Office Action issued in Japanese Patent Application No. 2020-214190.

Jul. 4, 2023 Office Action issued in Japanese Patent Application No. 2020-214190.

* cited by examiner

BLOWER

CROSS-REFERENCE TO RELATED APPLICATION

The present application claims priority to Japanese patent application Nos. 2020-214188 and 2020-214190, both of which were filed on Dec. 23, 2020. The contents of the foregoing applications are hereby fully incorporated herein by reference.

TECHNICAL FIELD

The present disclosure relates to an electric blower.

BACKGROUND

A known electric blower is capable of blowing off grit, dust, etc. by discharging air through a discharging opening. For example, Japanese Unexamined Patent Application Publication No. 2011-117442 discloses a blower (a so-called air duster) that is configured to suck air through an inlet opening, compress the air and discharge the compressed air through a nozzle, using a plurality of centrifugal fans rotated by a motor.

SUMMARY

In the above-described blower, the motor is arranged at a downstream side relative to the centrifugal fans in a flow passage. In such a blower, if the inlet opening is completely closed due to some reason, the air cannot be sucked through the inlet opening and the motor may generate excessive heat.

Accordingly, one, non-limiting object of the present disclosure is to provide techniques for improved motor protection.

One aspect of the present disclosure provides a blower that includes a body having a main inlet opening and a discharge opening, a motor assembly housed in the body, and an auxiliary inlet opening. The motor assembly includes a case, a motor and a fan. The case has a first opening and a second opening. The motor is housed within the case. The fan is configured to rotate in response to driving of the motor to generate a flow of air passing the main inlet opening, the first opening, the motor, the second opening and the discharge opening in this order. A first space is formed (defined) within the body. The first space communicates with the main inlet opening of the body and the first opening of the case. The auxiliary inlet opening is configured to introduce the air from an outside of the body into the first space.

In the blower of this embodiment, the air sucked through the main inlet opening in response to the rotation of the fan passes and cools the motor and is discharged through the discharge opening. According to this embodiment, even if a flow of air into the first space through the main inlet opening is interrupted (blocked) due to some reason, air can be introduced into the first space from the outside of the body through the auxiliary inlet opening, so that an air flow that passes the motor can be sustained. Accordingly, the likelihood of excessive heat generation of the motor can be reduced. The auxiliary inlet opening may be formed on (in) the body or other component that defines an internal space communicating with the first space.

DETAILED DESCRIPTION OF THE EMBODIMENTS

Figure 1:
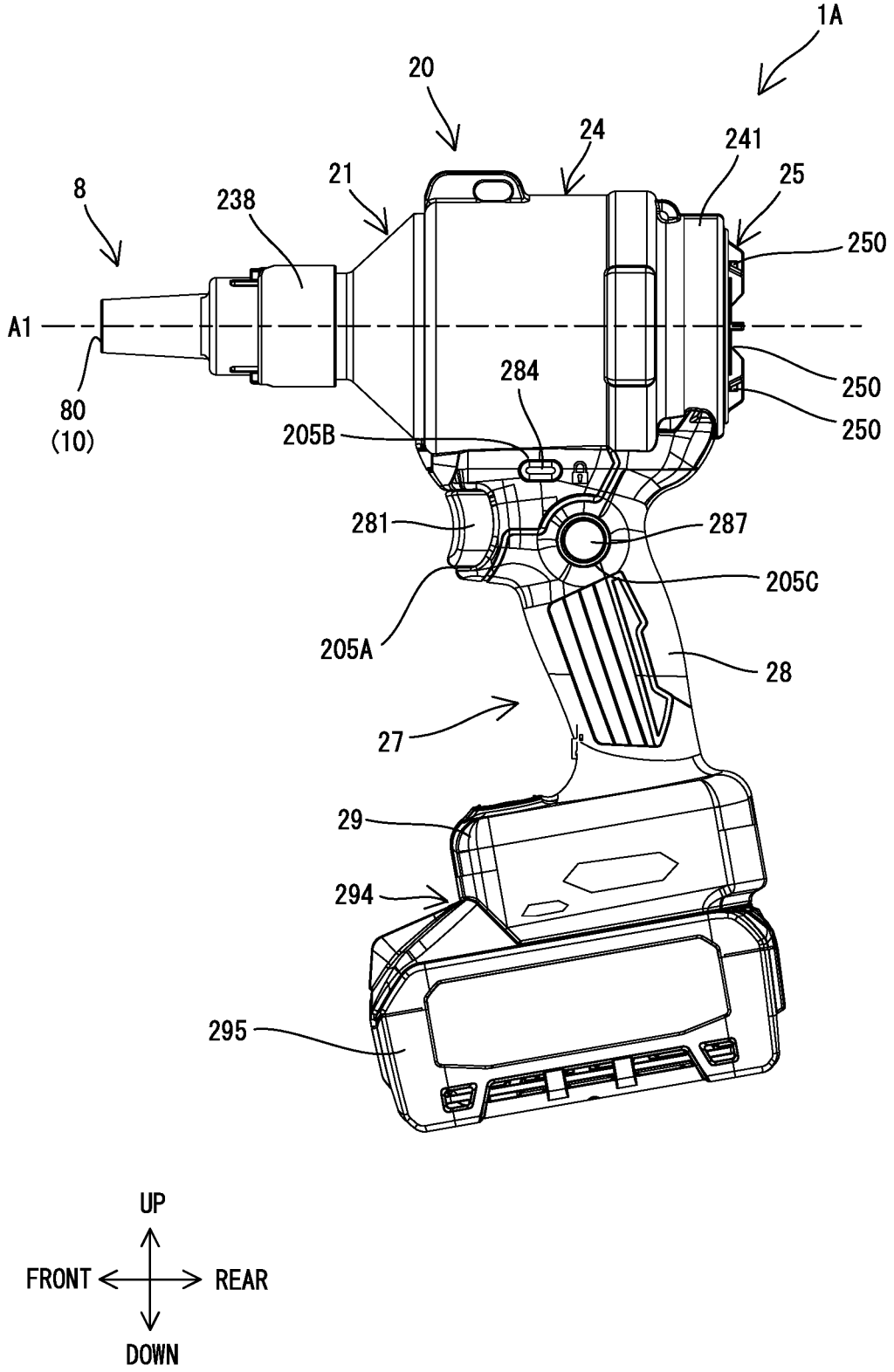
FIG. 1 is a left side view of an air duster.

In one non-limiting embodiment according to the present disclosure, the blower may further include a seal member. The body may include a motor housing that at least partially houses the motor assembly, and an outer shell that partially houses the motor housing. A first end of the motor housing may be inside (within) the outer shell. A second end of the motor housing may be outside the outer shell and may define the discharge opening. The seal member may be configured to isolate the first space formed (defined) inside (within) the outer shell and a second space formed (defined) inside (within) the motor housing from each other. The second space may communicate with the second opening of the case and the discharge opening. According to this embodiment, the seal member can prevent the air, which has been compressed by the rotation of the fan and has flowed out through the second opening of the case into the second space within the motor housing, from flowing into the first space within the outer shell. This configuration can suppress reduction of air-blowing efficiency.

In addition or in the alternative to the preceding embodiment, the motor housing may be a single (integral) member having a tubular shape. The outer shell may be formed by two halves connected with each other. The two halves may be divided in a direction that intersects a rotational axis of the fan. In this embodiment, the motor housing is a single member and is thus seamless. Accordingly, there is no opening, except for the discharge opening, that allows leak of the air that has been compressed by the rotation of the fan and that has flowed out into the second space, and thus reduction of the pressure in the second space can be effectively suppressed. On the other hand, the outer shell is formed by the two halves connected with each other. This configuration can facilitate coupling of the outer shell and the motor housing to each other.

In addition or in the alternative to the preceding embodiments, the motor housing may include a tapered part having an inner diameter decreasing toward the discharge opening. The motor housing of this embodiment can suppress a pressure loss and thus effectively increase the dynamic pressure of the air discharged through the discharge opening.

In addition or in the alternative to the preceding embodiments, the blower may further include a fixing member that is mounted on the motor housing to cover an opening at the first end of the motor housing and that has a communication opening. The seal member may be fixedly held by the fixing member. The fixing member of this embodiment can hold (retain) the seal member at an appropriate position while permitting the air to flow into the motor housing through the communication opening.

In addition or in the alternative to the preceding embodiments, the blower may further include a filter arranged between the main inlet opening and the communication opening. According to this embodiment, the filter can capture foreign matters (for example, dust), which have entered the body through the main inlet opening together with the air, so that the possibility that the motor is adversely affected by the foreign matters can be reduced.

In addition or in the alternative to the preceding embodiments, the blower may further include a handle configured to be held (gripped) by a user. At least a portion of the body may be formed integrally with the handle. The handle may have the auxiliary inlet opening. According to this embodiment, position of the auxiliary inlet opening can be more freely selected.

In addition or in the alternative to the preceding embodiments, the auxiliary inlet opening may be configured such that an air-passing state of the auxiliary inlet opening changes according to an air-passing state of the main inlet opening. In this embodiment, the auxiliary inlet opening may be configured such that an amount of air passing the auxiliary inlet opening increases in response to decrease in an amount of air passing the main inlet opening. According to this embodiment, the air-passing state of the auxiliary inlet opening can automatically change, and thus a user can utilize the blower without paying attention to the air-passing state of the main inlet opening. Consequently, the usability of the blower can be enhanced.

In addition or in the alternative to the preceding embodiments, the blower may further include a valve that is configured to selectively change a state of the auxiliary inlet opening between an open state and a closed state. According to this embodiment, the air-passing state of the auxiliary inlet opening can be reliably changed using the valve.

First Embodiment

An air duster 1A according to a first, non-limiting embodiment is now described in detail with reference to FIGS. 1 to 12. The air duster 1A is an example of an electric blower that is capable of blowing off grit, dust, etc., by discharging compressed air through a discharge opening 10. It is noted that, in FIGS. 2, 5 and 6, which are sectional views, a motor assembly 3 is simply schematically illustrated as one unit.

First, the general structure of the air duster 1A is briefly described.

Figure 2:
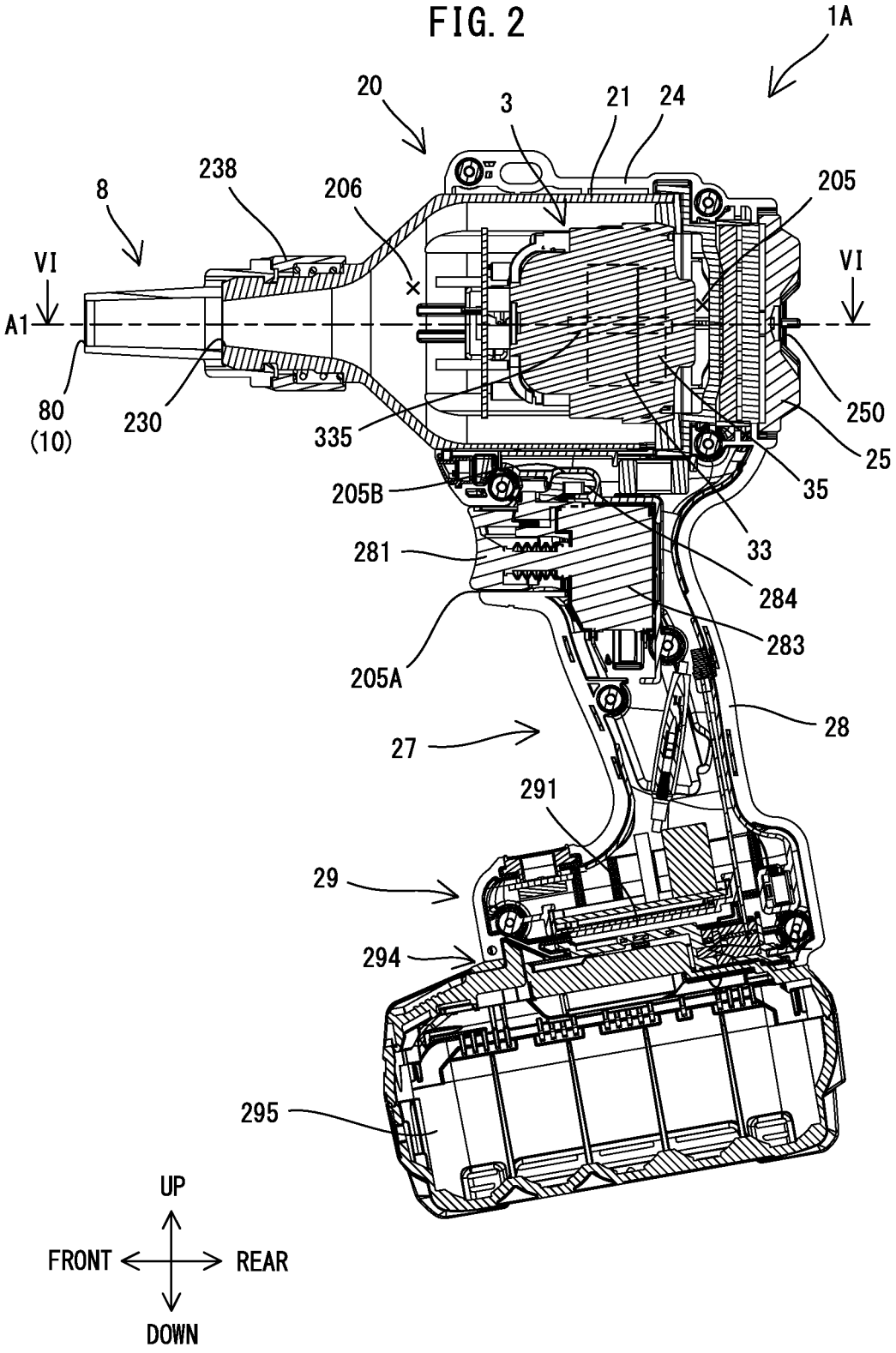
FIG. 2 is a sectional view of the air duster.

As shown in FIGS. 1 and 2, an outer shell of the air duster 1A is mainly formed by a body 20 that houses a motor 33 and a fan 35, and a handle 27 configured to be held by a user.

Figure 4:
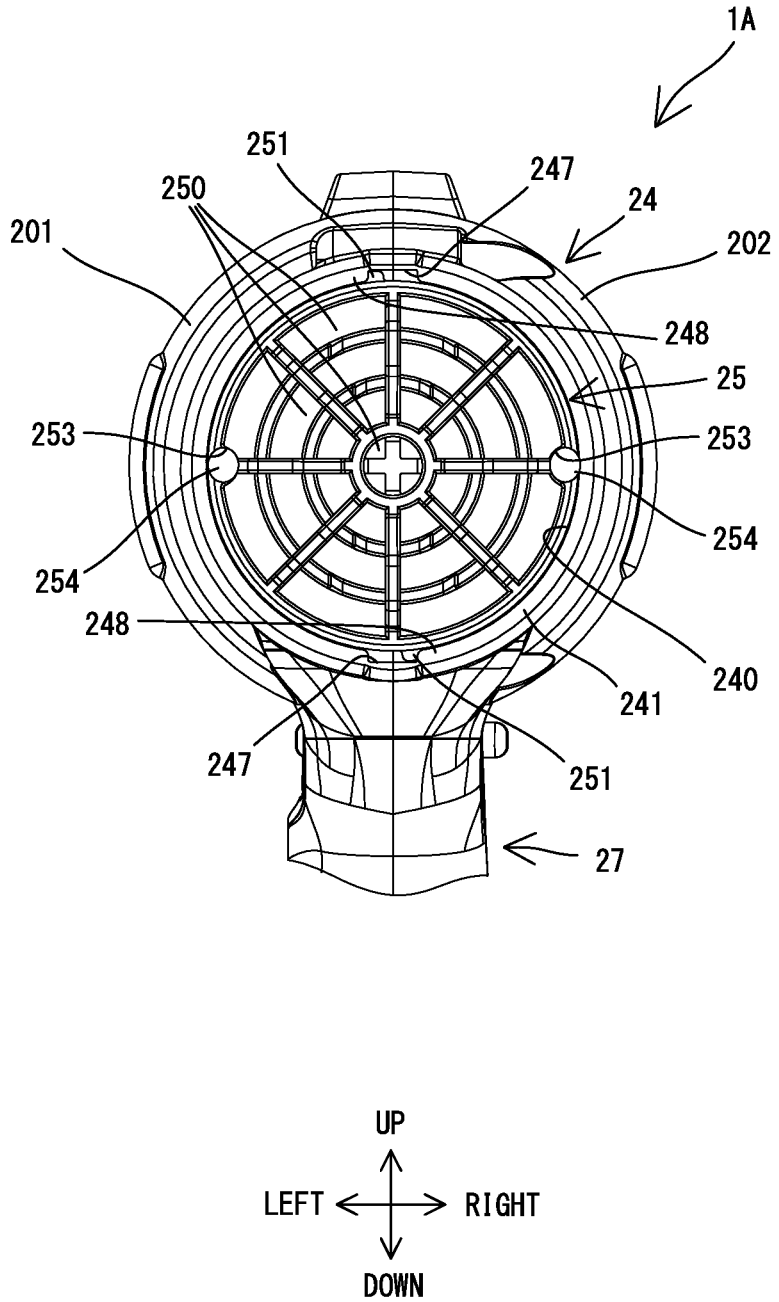
FIG. 4 is a partial, rear view of the air duster.

In this embodiment, as also shown in FIG. 4, inlet openings 250, through which air is sucked into the body 20, are formed at one end of the body 20 in an extension direction of a rotational axis A1 of a motor shaft 335 (hereinafter also simply referred to as a rotational-axis-A1 direction). A nozzle 8 is mounted on the other end of the body 20 in the rotational-axis-A1 direction. An opening 80 at a tip end of the nozzle 8 defines the discharge opening 10, through which compressed air is discharged. The handle 27 is a portion to be held by the user and extends from the body 20 in a direction that intersects the rotational axis A1. The inlet openings 250 and the discharge opening 10 are located on opposite sides of the motor 33 and the fan 35 in the rotational-axis-A1 direction. Such arrangement of the inlet openings 250, the discharge opening 10 and the handle 27 realizes the air duster 1A that can be easily manipulated by the user holding the handle 27.

A trigger 281, which is configured to be manually depressed by the user, is disposed at a base end portion (an end portion connected to the body 20) of the handle 27. Further, a battery 295 is removably coupled to (mounted on) a protruding end portion (a distal end portion) of the handle 27. When the trigger 281 is depressed by the user, the motor 33 is energized and the fan 35 is rotationally driven, and thereby compressed air is discharged through the discharge opening 10.

Figure 3:
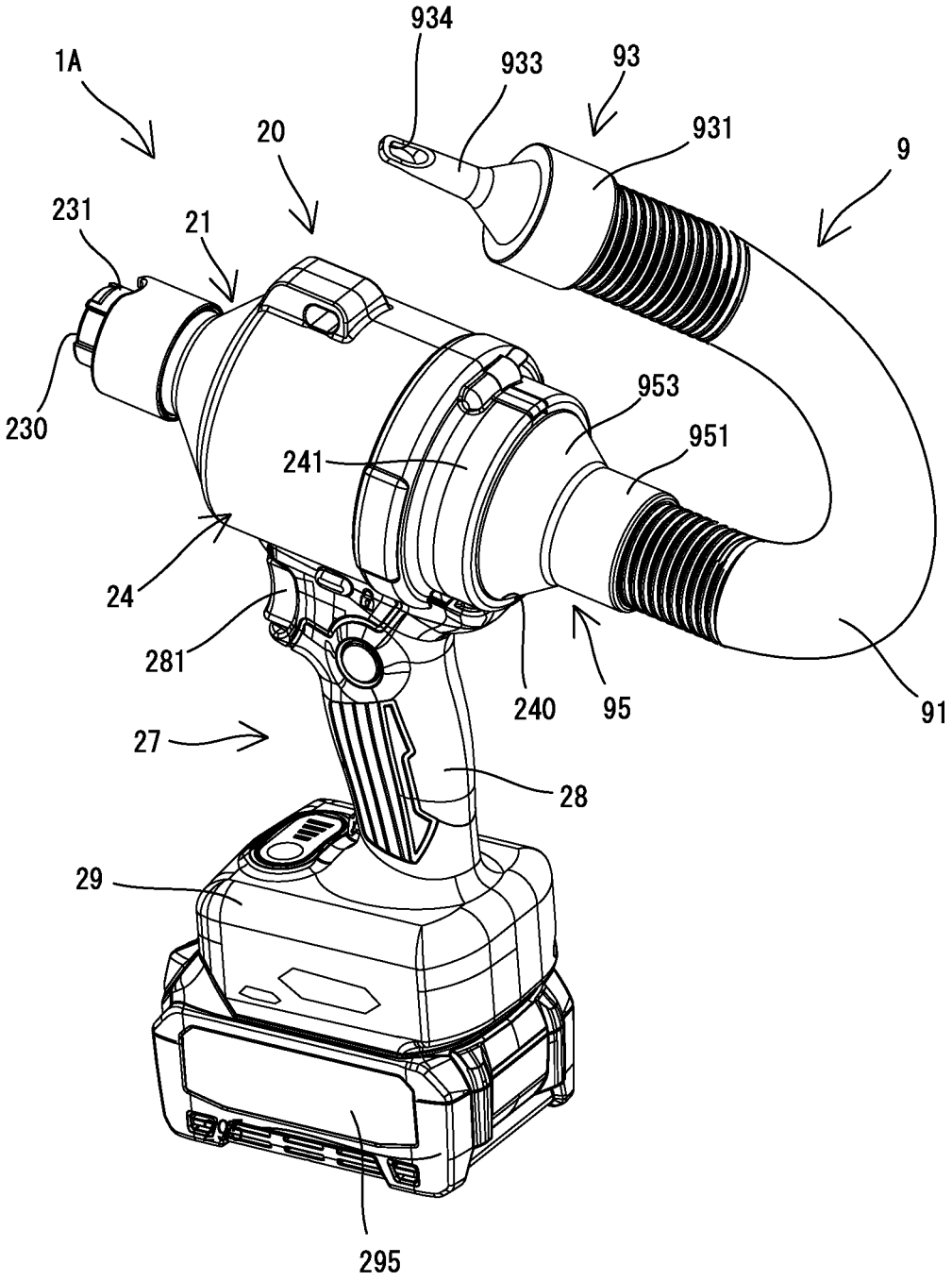
FIG. 3 is a perspective view of the air duster on which a suction attachment is mounted wherein a bellows structure of a hose is partially simplified.

In this embodiment, as shown in FIG. 3, the air duster 1A may also be used as a suction device by replacing the inlet-side cover 25 having the inlet openings 250 with a suction attachment 9. When the air duster 1A is used as the suction device, in response to rotation of the fan 3, air is sucked through a suction opening 934 of a suction nozzle 93 of the suction attachment 9.

The detailed structure of the air duster 1A is now described. In the following description, for the sake of convenience, the rotational-axis-A1 direction is defined as a front-rear direction of the air duster 1. In the front-rear direction, a direction from the inlet openings 250 toward the discharge opening 10 is defined as a forward direction, and an opposite direction thereof (a direction from the discharge opening 10 toward the inlet openings 250) is defined as a rearward direction. A direction that is orthogonal to the rotational-axis-A1 direction and that generally corresponds to the extension direction of the handle 27 is defined as an up-down direction of the air duster 1. In the up-down direction, a direction toward which the handle 27 protrudes from the body 20 (a direction from the body 20 toward the distal end portion of the handle 27) is defined as a downward direction, and an opposite direction thereof (a direction from the distal end portion of the handle 27 toward the body 20) is defined as an upward direction. A direction that is orthogonal to both the front-rear direction and the up-down direction is defined as a left-right direction of the air duster 1.

Figure 5:
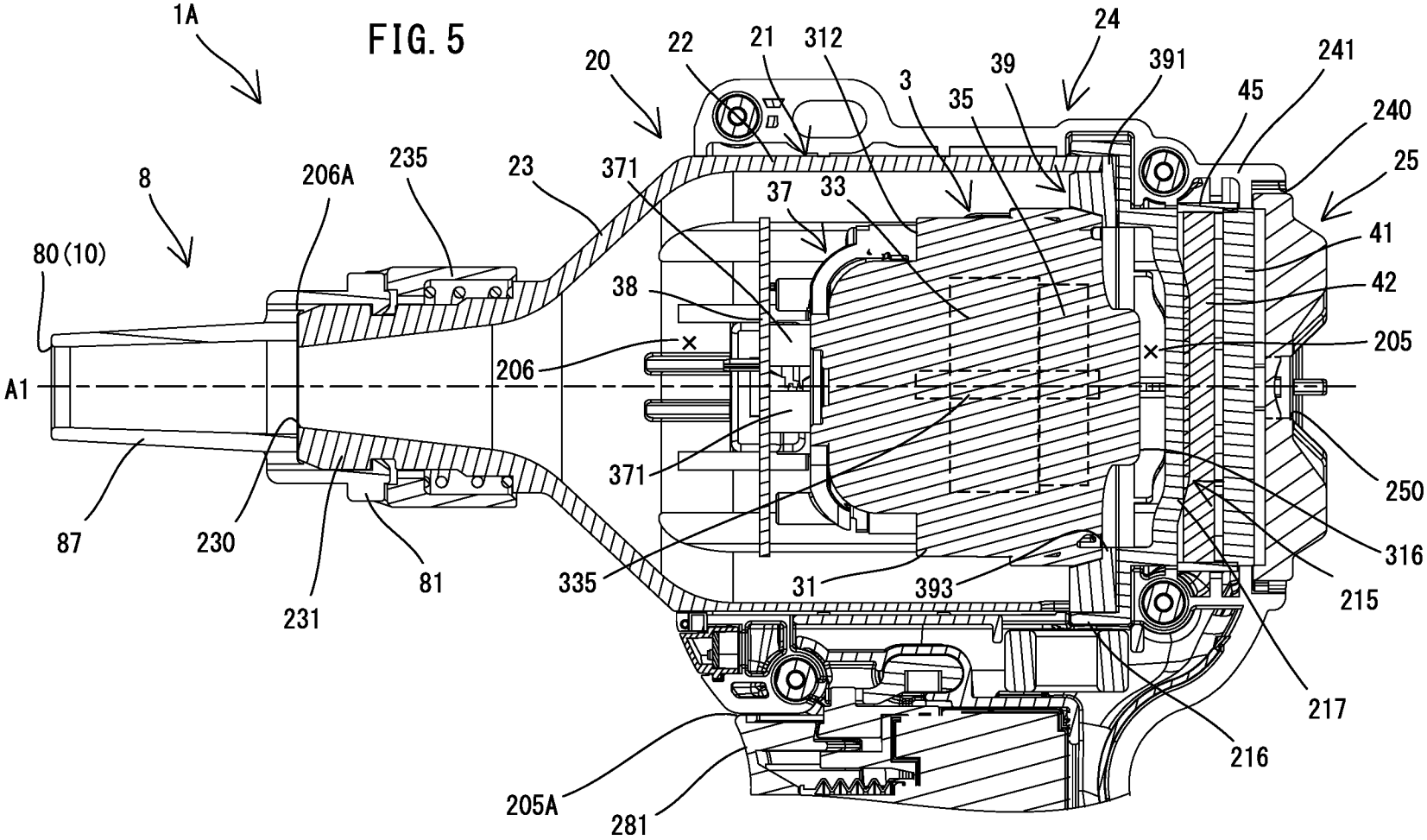
FIG. 5 is a partial, enlarged view of FIG. 2.
Figure 6:
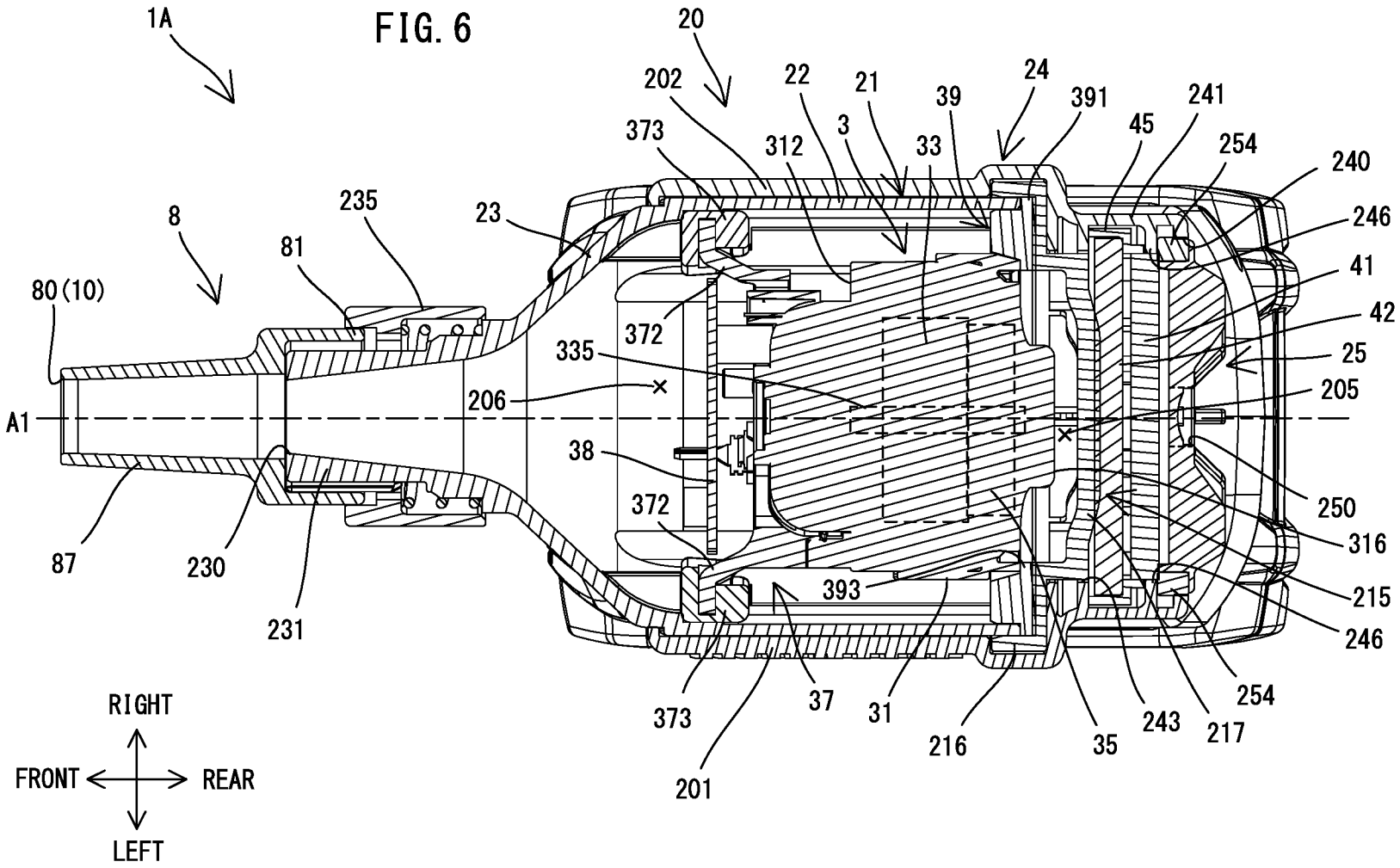
FIG. 6 is a sectional view taken along line VI-VI in FIG. 2.

First, the body 20 is described. As shown in FIGS. 4 to 6, the body 20 includes a tubular housing 21, the outer shell 24 and an inlet-side cover 25.

The tubular housing 21 is a tubular member having open opposite ends. In this embodiment, the tubular housing 21 includes a housing part 22 and a nozzle part 23. The housing part 22 is a portion of the tubular housing 21 within which the motor 33 and the fan 35 are disposed. The housing part 22 is configured as a hollow cylindrical body having a substantially uniform inner diameter and a substantially uniform outer diameter. The nozzle part 23 has a funnel shape as a whole and extends forward from a front end of the housing part 22. An opening 230 at the front end of the nozzle part 23 is a discharging opening, through which the air is discharged from the body 20. In this embodiment, the tubular housing 21 is a single, seamless member. In other words, the housing part 22 and the nozzle part 23 are formed integrally with each other (in a non-separable manner).

However, the housing part 22 and the nozzle part 23 may be separate (discrete) members that are connected to each other.

The nozzle part 23 is configured such that the inner diameter of the nozzle part 23 decreases toward a tip end (a front end) as a whole, in order to effectively increase dynamic pressure of air discharged through the opening 230. More specifically, as shown in FIGS. 5 and 6, an inner peripheral surface of a rear portion of the nozzle part 23 is inclined at a first angle relative to the rotational axis A1 of the fan 35 in a section containing the rotational axis A1. An inner peripheral surface of a front portion of the nozzle part 23 is inclined at a second angle relative to the rotational axis A1 in this section, and the second angle is smaller than the first angle (i.e., the second angle is a sharper angle). Thus, the inner peripheral surface of the nozzle part 23 is formed as a two-stage tapered surface. The inner peripheral surface of the rear portion of the nozzle part 23 and the inner peripheral surface of the front portion of the nozzle part 23 are connected to each other via a gentle curved surface. Such a structure can suppress a pressure loss compared to a structure in which the inner peripheral surface of the rear portion of the nozzle part 23 and the inner peripheral surface of the front portion of the nozzle part 23 are directly connected at an angle.

The nozzle 8 can be removably mounted on (coupled to, attached to) the front end portion of the nozzle part 23. More specifically, a locking mechanism 235, which is configured to lock the nozzle 8 to the body 20 at a specified mounting position, is disposed around the front end portion of the nozzle part 23. The nozzle 8 is mounted on the front end portion of the nozzle part 23 via the locking mechanism 235. Thus, the front end portion of the nozzle part 23 is also referred to as a nozzle mounting part 231. When the nozzle 8 is not mounted on the nozzle mounting part 231, the opening 230 serves as the discharge opening 10 of the air duster 1A. It is noted that the structure that enables the nozzle 8 to be removably mounted on the body 20 is not limited to the locking mechanism 235, and any known structure can be employed.

The nozzle 8 is now described. The nozzle 8 is an attachment configured to be additionally mounted on (coupled to, attached to) the air duster 1A for use with the air duster 1. More specifically, the nozzle 8 is a tubular body as a whole and has a through hole extending in its axial direction. The nozzle 8 of this embodiment includes a mounting part 81 and a passage part 87 that are coaxially connected to each other. The mounting part 81 is configured to be mounted on (coupled to, attached to) the body 20 (specifically, the locking mechanism 235) of the air duster 1. The passage part 87 is an elongate tubular body and extends in the axial direction of the nozzle 8 from one end of the mounting part 81. When the nozzle 8 is mounted on the body 20, the opening 80 at the tip end of the passage part 87 defines the discharge opening 10 of the air duster 1A.

Various kinds of nozzles 8 are available for use with the air duster 1, aside from the nozzle 8 exemplarily described and shown in this embodiment. These nozzles 8 have different axial lengths and/or different diameters of the opening 80 (the discharge opening 10), respectively. The user can use the air duster 1A without the nozzle 8 or with one of those nozzles 8 that is suitable for the kind of the operation to be performed using the air duster 1.

The outer shell 24 has a generally hollow cylindrical shape as a whole, and surrounds a portion (specifically, the housing part 22) of the tubular housing 21. A rear end portion of the outer shell 24 protrudes rearward of the tubular housing 21. Thus, a rear end portion of the housing part 22 is entirely within the outer shell 24. An opening 240 is formed at a rear end of the outer shell 24. The opening 240 is substantially circular as viewed from the rear. A portion (specifically, the nozzle part 23) of the tubular housing 21 protrudes forward from an open front end of the outer shell 24.

In this embodiment, the outer shell 24 is made of synthetic resin, and formed integrally with the handle 27. More specifically, a left portion of the outer shell 24 and a left portion of the handle 27 are integrated to form a left shell 201 (a left half). Similarly, a right portion of the outer shell 24 and a right portion of the handle 27 are integrated to form a right shell 202 (a right half). The left shell 201 and the right shell 202 are fixedly connected to each other in the left-right direction by screws, so that the outer shell 24 and the handle 27 are formed and the tubular housing 21 and the outer shell 24 are connected to each other in a substantially immovable manner relative to each other.

The inlet-side cover 25 is a cover member (cap) that covers the opening 240 of the rear end portion 241 of the outer shell 24. Multiple inlet openings 250 are formed through the inlet-side cover 25. The inlet-side cover 25 is mounted on (connected/attached to) the outer shell 24 for the purpose of blocking fingers of the user from entering the body 20 and thus the inlet openings 250 are formed in the inlet-side cover 25. However, the opening 240 can be considered as the substantial inlet opening of the body 20 (the outer shell 24). When the fan 35 is rotated, air is sucked from the outside into an inside (internal space) of the body 20 through the inlet openings 250 (the opening 240).

In this embodiment, the inlet-side cover 25 can be mounted on (connected/attached to) and removed from the rear end portion 241 of the outer shell 24 without use of a separate device/tool (e.g., a screwdriver). The engagement structure between the rear end portion 241 and the inlet-side cover 25 is now described.

Figure 7:
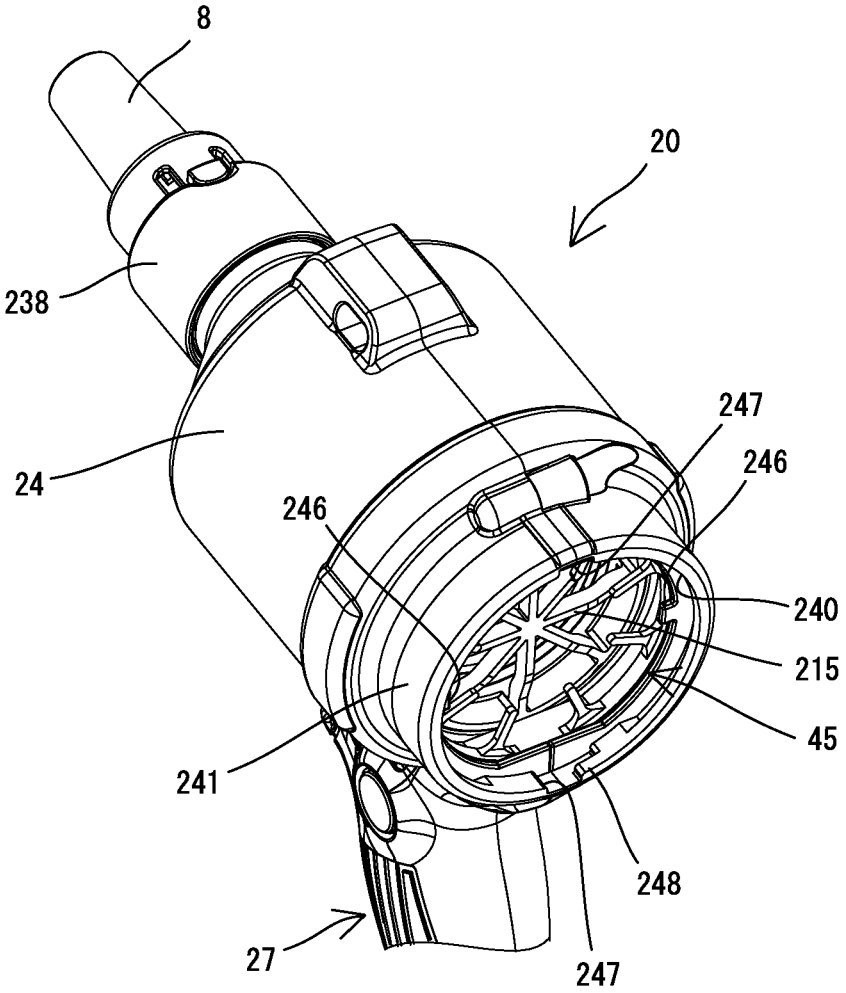
FIG. 7 is a partial, perspective view of the air duster wherein an inlet-side cover is removed.
Figure 8:
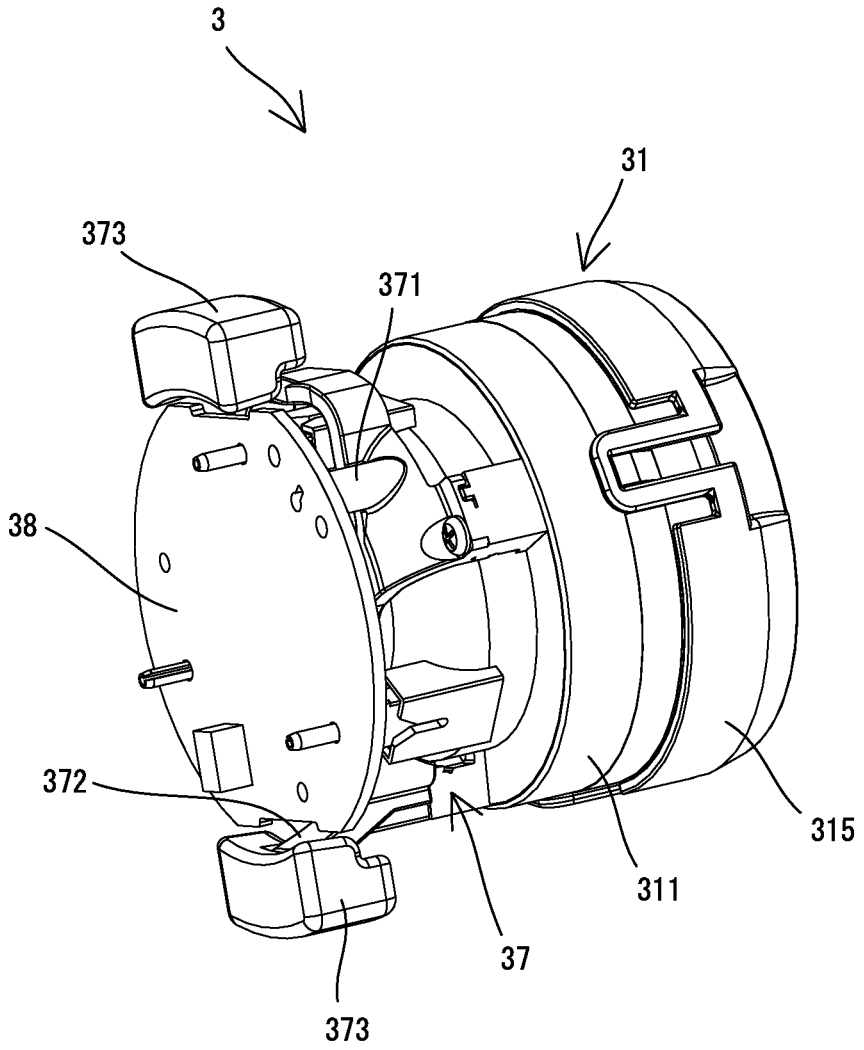
FIG. 8 is a perspective view of a motor assembly.

As shown in FIG. 7, engagement grooves 147 are formed on the inner peripheral surface of the filter mounting part 241 at an upper rear end portion and at a lower rear end portion of the filter mounting part 241, respectively. Each of the engagement grooves 247 is L-shaped and includes a first portion that extends forward from the rear end of the outer shell 24 and a second portion that extends in the circumferential direction of the filter mounting part 241 from a front end portion of the first portion. Thus, there is a wall portion 248 at the rear side of the second portion of each groove 247.

As shown in FIG. 4, two protrusions 251 protrude radially outward from an outer peripheral surface of the inlet-side cover 25. Further, two recesses 253 are formed on (in) the outer peripheral surface of the inlet-side cover 25. A cylindrical elastic pin 254 is fitted in and held in each of the recesses 253. The elastic pin 254 slightly protrudes radially outward on the inlet-side cover 25. In this embodiment, the elastic pin 254 is made of rubber (namely, the elastic pin 254 is a rubber pin). However, the elastic pin 254 may be made of other elastic material (for example, synthetic resin).

When mounting the inlet-side cover 25 on the filter mounting part 241, the user moves the inlet-side cover 25 forward relative to the filter mounting part 241 such that the protrusions 251 respectively enter the first portions of the engagement grooves 247 from behind. Thereafter, the user rotates the inlet-side cover 25 such that the protrusions 251 respectively move in the circumferential direction within the second portions. Accordingly, the protrusions 251 are respectively disposed in front of the wall portions 248. Each of the wall portions 248 abuts on the rear surface of the corresponding protrusion 251 to thereby block rearward movement of the inlet-side cover 25. Further, the elastic pins 254 each abut on the inner peripheral surface of the filter mounting part 241 to cause frictional resistance, so that the elastic pins 254 restrict rotation of the inlet-side cover 25 relative to the outer shell 24. Thus, the elastic pins 254 can reduce the likelihood that the inlet-side cover 25 drops off from the filter mounting part 241. On the other hand, the user can easily remove the inlet-side cover 25 from the filter mounting part 241, by moving the inlet-side cover 25 relative to the filter mounting part 241 in a direction opposite to the direction in mounting the inlet-side cover 25.

The elements/components disposed within the body 20 are now described.

As shown in FIG. 5, the motor 33, the fan 35 and two filters (a first filter 41 and a second filter 42) are disposed within the body 20. When the air duster 1A is viewed in a direction that is orthogonal to the rotational axis A1 (for example, viewed from the left side or the right side of the air duster 1), the inlet opening 250, the first filter 41, the second filter 42, the fan 35, the motor 33 and the discharge opening 10 are aligned (arranged) from the rear toward the front in this order on (along) a straight line extending in the front-rear direction.

Figure 9:
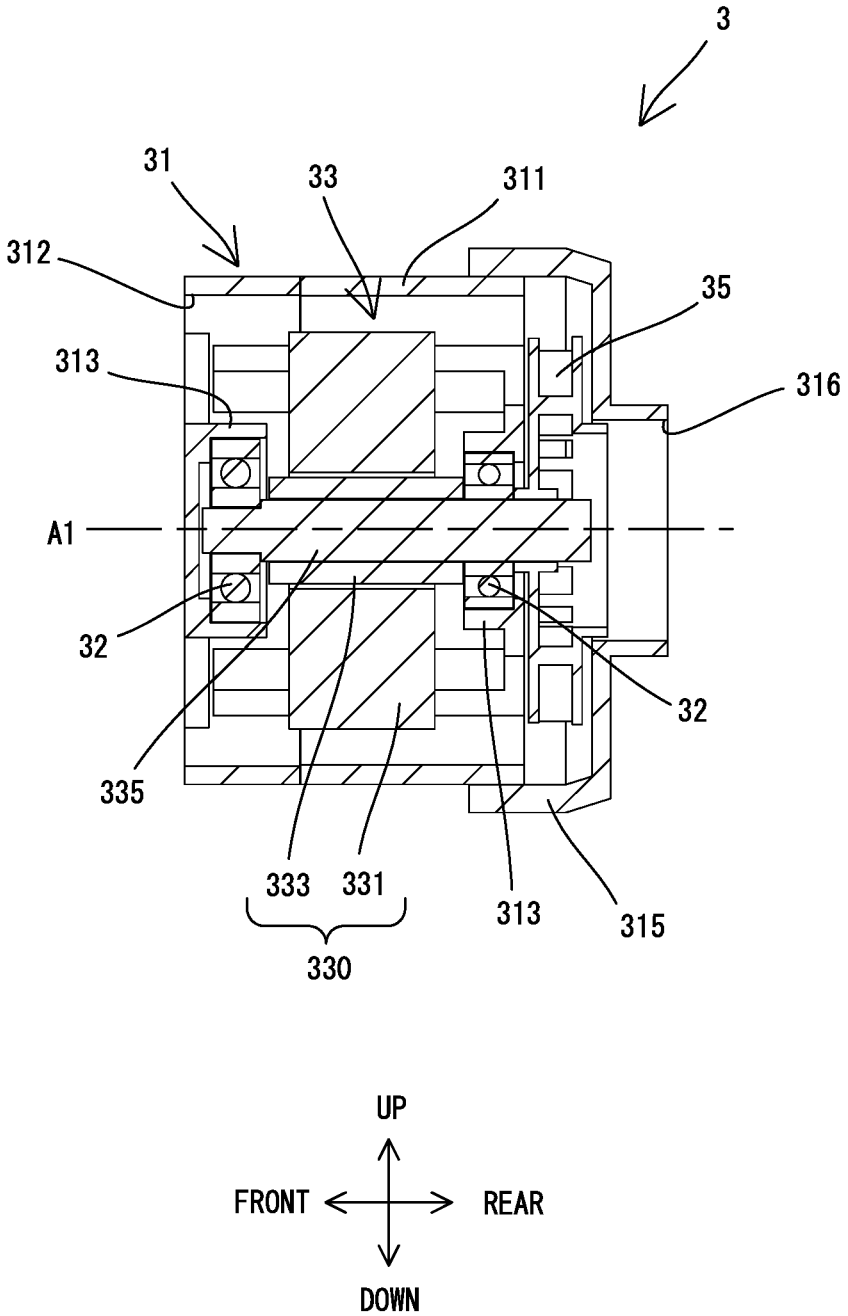
FIG. 9 is a sectional view of the motor assembly wherein a support member and a circuit board are not shown.

First, the motor 33 and the fan 35 are described. In this embodiment, the motor 33 and the fan 35 are integrated with related parts to form a motor assembly 3. The motor assembly 3 as one component (integrated unit) is supported in the body 20. More specifically, as shown in FIGS. 5, 6, 8 and 9, the motor assembly 3 includes a case 31, two bearings 32, the motor 33, the fan 35, a support member 37 and a circuit board 38. In FIG. 9, for the sake of convenience, the support member 37 and the circuit board 38 are not shown.

The case 31 is a hollow body that houses the motor 33 and the fan 35 and supports the bearings 32. The case 31 includes a peripheral wall 311, a cover 315 and two bearing support parts 313. The peripheral wall 311 is a cylindrical wall having an axis extending in the front-rear direction. The cover 315 has a short, bottomed cylindrical shape. The cover 315 is fitted and fixed to the peripheral wall 311 to cover an open rear end of the peripheral wall 311. A rear wall of the cover 315 is substantially orthogonal to the rotational axis A1. A circular first opening 316 is formed at a central portion of the rear wall of the cover 315 such that the inside (internal space) and the outside of the case 31 communicates each other. The bearing support parts 313 are respectively disposed in a front end portion and a rear end portion of the peripheral wall 311. The bearing support parts 313 are formed integrally with the peripheral wall 311. Each of the two bearings 32 (specifically, an outer ring of each ball bearing) is fitted in and supported by the bearing support part 313. A second opening 312 is formed between the peripheral wall 311 and the front bearing support part 313 such that the inside (internal space) and the outside of the case 31 communicates each other.

The motor 33 is an inner-rotor brushless motor. The motor 33 includes a motor body 330, which includes a stator 331 and a rotor 333, and the motor shaft 335. The stator 331 is fixedly supported within the case 31 by a plurality of ribs disposed on an inner peripheral surface of the peripheral wall 311 of the case 31. The rotor 333 and the motor shaft 335 are fixed with each other to be rotatable together. The motor shaft 335 is supported by the two bearings 32, which are supported by the bearing support parts 313 of the case 31 in front of and behind the rotor 333, so as to be rotatable around the rotational axis A1. A rear end portion of the motor shaft 335 is disposed in the cover 315.

Only one (single) fan 35 is fixed to the rear end portion of the motor shaft 335 (the end portion arranged in the cover 315). The fan 35 is a centrifugal fan that sucks air from the rear in the rotational-axis-A1 direction and feeds (delivers) the air radially outward. The fan 35 is arranged such that a central portion of the fan 35 on its suction side faces the first opening 316 of the cover 315.

When the fan 35 is rotated, air is sucked into the case 31 through the first opening 316 of the rear end portion (the cover 315) of the case 31. The air is fed radially outward of the fan 35, cools the motor 33 while flowing around the stator 331 and between the stator 331 and the rotor 333 in the rotational-axis-A1 direction, and flows out of the case 31 through the second opening 312 of the front end portion of the case 31. Thus, the first opening 316 in the rear end portion (the cover 315) of the case 31 functions as an inlet opening that directs air into the case 31. The second opening 312 of the front end portion of the case 31 functions as a discharge opening that discharges the air out of the case 31.

In this embodiment, while the motor 33 is a relatively high-speed motor (e.g., having a maximum rotational speed of at least 80,000 rpm), the fan 35 is a relatively small single fan (e.g., having a diameter within a range of 40 mm to 45 mm). By employing such a fan 35, the body 20 can be made relatively small in the rotational-axis-A1 direction and the radial direction of the fan 35.

The support member 37 is fixed to the front end portion of the case 31. The support member 37 includes a first arm 371 extending forward of the case 31, and two second arms 372 each extending forward and radially outward of the case 31. The first arm 371 supports the circuit board 38. A control circuit etc. are mounted on the circuit board 38. The control circuit is configured to control energizing to a coil of the stator 331 in response to a control signal from the controller 291. The two second arms 372 are arranged to face each other across the rotational axis A1. Each of the second arms 372 extends to a position substantially the same as that of the circuit board 38 in the front-rear direction and extends radially outward of the circuit board 38. A distal end portion of the second arm 372 is covered with an elastic cover 373 formed of an elastic body.

The structures for supporting the motor assembly 3 are now described.

As shown in FIGS. 5 and 6, the motor assembly 3 is housed in the tubular housing 21 (specifically, in the housing part 22) of the body 20. More specifically, the motor assembly 3 is elastically connected to and supported by the tubular housing 21 via the above-described elastic covers 373 mounted on (fitted on, around) the second arms 372 of the support member 37 and a seal ring 39 disposed between the tubular housing 21 and the case 31.

Figure 10:
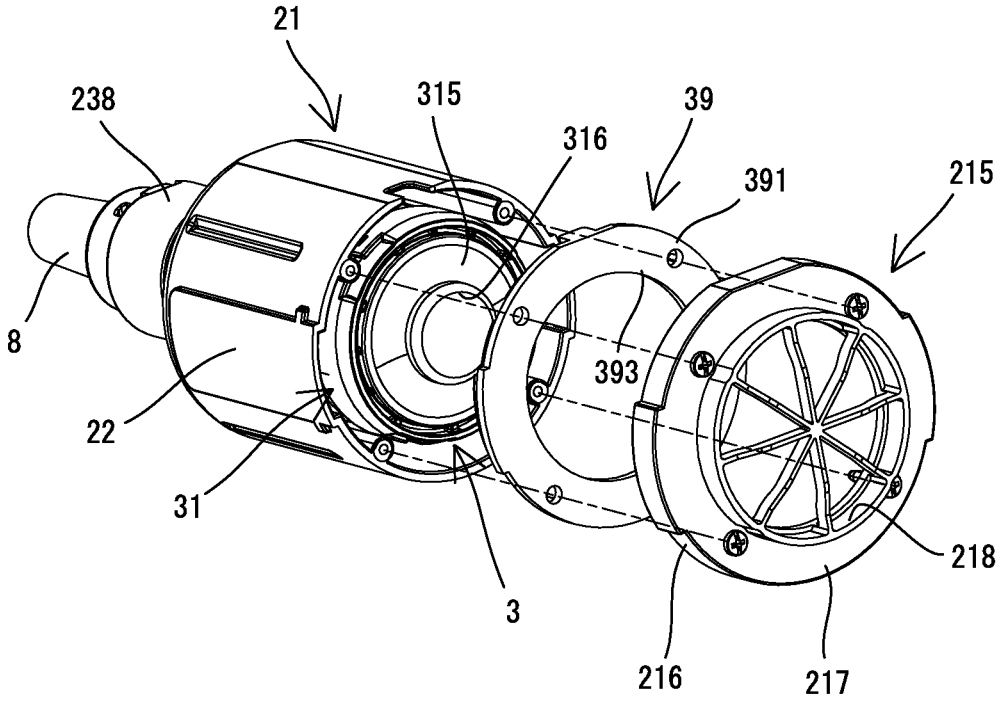
FIG. 10 is an exploded perspective view of a tubular housing, a seal ring and a fixing member.

As shown in FIGS. 5, 6 and 10, the seal ring 39 is an elastic body having a short, generally hollow cylindrical shape (or a generally ring (annular) shape) as a whole. In this embodiment, the seal ring 39 is made of silicone rubber. However, the seal ring 39 may be made of any elastic material other than silicone rubber (for example, rubber or other kinds of elastomer). An outer peripheral surface and an inner peripheral surface of the seal ring 39 are configured to substantially match (conform to) the inner peripheral surface of the rear end portion of the tubular housing 21 and the outer peripheral surface of the rear end portion of the case 31, respectively, when the seal ring 39 is slightly compressed. Further, a rear end portion of the seal ring 39 has an outer flange 391 that protrudes radially outward and an inner flange 393 that protrudes radially inward. The outer diameter of the outer flange 391 is substantially the same as the outer diameter of the tubular housing 21. The inner diameter of the inner flange 393 is smaller than the outer diameter of the cover 315 of the case 31.

The seal ring 39 is connected to the tubular housing 21 using a fixing member 215. The fixing member 215 includes a peripheral wall 216 to be fitted around the rear end portion of the tubular housing 21, and a pressing part 217 having substantially the same shape as a rear surface of the seal ring 39. Thus, the pressing part 217 has a generally ring (annular) shape and has an opening 218 at the center of the pressing part 217. A plurality of radial ribs (finger guards) are disposed in the opening 218 and connected to the pressing part 217. The opening 218 functions as a communication opening (an inlet opening of the tubular housing 21) that leads air, which has flowed into the outer shell 24 through the inlet opening 250 (see FIG. 3), into the tubular housing 21.

Each of the pressing part 217 of the fixing member 215 and the seal ring 39 has insertion holes for screws formed at intervals in the circumferential direction. Screws are inserted into the insertion holes of the pressing part 217 and the seal ring 39 from the rear side of the pressing part 217, and screwed into screw holes formed in the tubular housing 21, so that the seal ring 39 is pressed against the tubular housing 21 and the case 31 by the fixing member 215.

The outer flange 391 and the inner flange 393 of the seal ring 39 are thus in close contact with a rear end surface of the tubular housing 21 and a rear surface of the rear wall of the cover 315, respectively. Further, a portion of the seal ring 39 other than the rear end portion is slightly compressed and fitted between the rear end portion of the case 31 (the cover 315) and the rear end portion of the tubular housing 21 in the radial direction, so that the portion of the seal ring 39 is in close contact with the outer peripheral surface of the case 31 and the inner peripheral surface of the tubular housing 21. In this manner, the fixing member 215 fixedly holds (retains) the seal ring 39 at an appropriate position relative to the tubular housing 21 and the case 31, while allowing air to flow into the tubular housing 21 through the communication opening 218 (opening).

Further, the elastic covers 373 mounted on the two second arms 372 of the support member 37 are supported while positioned relative to the tubular housing 21 in the front-rear direction and rotation of the motor assembly 3 is restricted. The motor assembly 3 is thus elastically held in a state in which the motor assembly 3 is spaced apart inward from the inner peripheral surface of the tubular housing 21. This configuration can effectively reduce vibration, which is caused by the driving of the motor 33, to be transmitted from the motor assembly 3 to the body 20 (the tubular housing 21) and thus to the outer shell 24 and the handle 27.

The tubular housing 21 is connected to the outer shell 24 in a state in which the motor assembly 3 is mounted in the tubular housing 21 and the seal ring 39 and the fixing member 215 are connected to the tubular housing 21 as described above. More specifically, the tubular housing 21 is positioned by the ribs (the protruding pieces) disposed on the inner peripheral surface of the outer shell 24 and held between the left shell 201 and the right shell 202 to be substantially immovable relative to the outer shell 24.

Owing to the structures and arrangements described above, as shown in FIGS. 5 and 6, the seal ring 39 partitions (separates) a space formed between the body 20 (the tubular housing 21, the outer shell 24 and the inlet-side cover 25) and the motor assembly 3 (specifically, the case 31), into (i) a first space 205 that communicates with the inlet opening 250 and the first opening 316 of the rear end portion of the case 31 and (ii) a second space 206 that communicates with the second opening 312 of the front end portion of the case 31 and the discharge opening 10. The first space 205 and the second space 206 may also be referred to as a suction-side space of the fan 35 and a discharge-side space of the fan 35, respectively. Further, in this embodiment, the first space 205 and the second space 206 may also be referred to as a rear-side space and a front-side space with respect to the seal ring 39, respectively. The seal ring 39 is configured to prevent air, which has flowed into the second space 206 through the second opening 312 at the front end portion of the case 31, from flowing into the first space 205. This structure (configuration) can suppress reduction of the air-blowing efficiency.

The second space 206 is a space formed within the tubular housing 21 and the air compressed by the fan 35 flows in the second space 206. In this embodiment, the second space 206 is formed within the tubular housing 21, which is a single (seamless) member, so that the air blown into the second space 206 is prevented from leaking out through a portion other than the discharge opening 10, and thus a pressure reduction in the second space 206 can be effectively suppressed.

In this embodiment, the seal ring 39 has a tubular shape (a ring (annular) shape) and the seal ring 39 can be partially fitted (inserted) between the inner peripheral surface of the tubular housing 21 and the outer peripheral surface of the case 31 in the radial direction, in close contact with the inner peripheral surface of the tubular housing 21 and the outer peripheral surface of the case 31. Thus, the first space 205 and the second space 206 can be easily and securely isolated from each other by the seal ring 39 having such a simple structure.

The first filter 41 and the second filter 42 are now described.

As shown in FIGS. 5 and 6, the first filter 41 and the second filter 42 are arranged between the inlet-side cover 25 and the motor assembly 3, in the rear end portion of the body 20 (the outer shell 24). The first filter 41 and the second filter 42 can capture the foreign matters (e.g., dust) that have entered the body 20. Accordingly, the possibility that foreign matters adversely affect the motor 33 can be effectively reduced.

In this embodiment, the first filter 41 is mounted in (held in) the rear end portion 241 such that the first filter 41 is easily removable from the outer shell 24. The first filter 41 is placed in front of two protrusions 246 protruding into the rear end portion 241 and held in position using elasticity of the first filter 41. The user can easily remove the first filter 41 from the outer shell 24 by simply pulling the first filter 41. The second filter 42 is arranged in front of the first filter 41 (at the side of the motor assembly 3 relative to the first filter 41) in the rear end portion 241. The second filter 42 is mounted (held) in the outer shell 24 via a filter holder 45. Although not shown in detail, the filter holder 45 has a peripheral wall and multiple protrusions. The protrusions protrude radially inward from a rear end portion of the peripheral wall and restrict rearward movement of the second filter 42. Owing to these protrusions of the filter holder 45, rearward movement of the second filter 42 is restricted and thus the second filter 42 is not as easily removable from the filter mounting part 241 as the first filter 41.

Further, in this embodiment, the first filter 41 and second filter 42 are polyurethane sponges having different mesh sizes (sizes and arrangement of open cells). More specifically, the mesh size of the second filter 42 is larger than that of the first filter 41. This is because the second filter 42 is more troublesome to be removed, and it is thus preferable to employ a filter that is less likely to be clogged (i.e., a filter having a relatively large mesh size) as the second filter 42. On the other hand, the first filter 41 is easily removable for its cleaning or replacement when the first filter 41 is clogged. Accordingly, it is preferable to employ a filter having superior capturing performance of the foreign matters (i.e. a filter having a relatively small mesh size) as the first filter 41. Thus, a rational structure can be realized for capturing the foreign matters in two stages.

The handle 27 and elements/components disposed within the handle 27 are now described.

As shown in FIGS. 1 and 2, the handle 27 is a hollow body that includes a tubular grip part 28 extending generally in the up-down direction and a rectangular box-like controller-housing part 29 connected to a lower end of the grip part 28. In this embodiment, the handle 27 is made of synthetic resin (polymeric material), and formed integrally with an outer shell 24 of the body 20, as described above.

The grip part 28 is a portion to be held by the user when the air duster 1A is used (operated). The trigger 281 is provided at a front upper end portion of the grip part 28. More specifically, the trigger 281 is inserted in a through hole formed in an upper front end portion of a peripheral wall that forms (defines) the grip part 28. The trigger 281 is thus held to be movable in the front-rear direction. A switch 283 is housed within the grip part 28.

In a non-pressed state, the trigger 281 is biased forward and kept at (in) its foremost position (also referred to as an OFF position). In this state, the switch 283 is kept OFF. When the trigger 281 is manually depressed and moves rearward of a specific position, the switch 283 is turned ON. The switch 283 is electrically connected to a controller 291 via wires (not shown). The switch 283 is configured to output to the controller 291 a signal corresponding to a manipulation amount (depressed amount) of the trigger 281 when the switch 283 is turned ON.

In this embodiment, the grip part 28 has a lock-off button 284 and a lock-on button 287. The lock-off button 284 is configured to lock the trigger 281 at (in) the OFF position. The lock-on button 287 is configured to lock the trigger 281 at (in) an ON position, where the trigger 281 is located rearward of the specific position. The structures of the lock-off button 284 and the lock-on button 287 are well-known and therefore described only briefly here and the detailed illustrations thereof are omitted.

The lock-off button 284 is disposed above the trigger 281 and is inserted into a pair of through holes formed in left and right side portions of the peripheral wall that forms the grip part 28. The lock-off button 284 is thus held to be movable in the left-right direction. When the lock-off button 284 is placed at (in) a lock position while the trigger 281 is at (in) the OFF position, the lock-off button 284 comes into contact with a protrusion of the trigger 281 from behind and blocks the trigger 281 from moving rearward. The lock-on button 287 is disposed at a position corresponding to the rear end portion of the trigger 281 and is inserted into a through hole formed in the left side portion of the peripheral wall that forms (defines) the grip part 28. The lock-on button 287 is thus held to be movable in the left-right direction. While the lock-on button 287 is in a non-pressed state, a right end portion of the lock-on button 287 does not interfere with the trigger 281. When the lock-on button 287 is manually depressed while the trigger 287 is at (in) the ON position, the right end portion of the lock-on button 287 engages with a recess formed on (in) the rear end portion of the trigger 281 and holds the trigger 287 in the ON position.

The controller-housing part 29 houses the controller 291. The controller 291 is configured to control various operations of the air duster 1. In this embodiment, the controller 291 is configured as a microcomputer that includes a CPU, a ROM, a RAM and a memory. In this embodiment, the controller 291 is configured to control the rotational speed of the motor 33 according to the signal outputted from the switch 282 (i.e., a manipulation amount of the trigger 281).

A battery mounting part 294, which is configured to removably receive the rechargeable battery (also referred to as a battery pack) 295, is provided in (at) a lower end portion of the controller-housing part 29. The battery mounting part 294 includes a rail structure for sliding engagement with grooves of the battery 295, and terminals that are electrically connectable to terminals of the battery 295. The structures of the battery mounting part 294 and the battery 295 themselves are well known and therefore not described here.

As described above, in the air duster 1A, air sucked through the inlet openings 250 in response to the rotation of the fan 35 passes and cools the motor 33 and then the air is discharged through the discharge opening 10 (the opening 230 or the opening 80). In the air duster 1A having such a structure, if the motor 33 continues to be driven in a state in which the inlet openings 250 are completely blocked (closed) due to some reason, the motor 33 cannot be sufficiently cooled and thus the motor 33 might generate excessive heat. Accordingly, in this embodiment, auxiliary inlet openings 205A, 205B and 205C are provided for introducing air into the first space 205 even if the inlet opening 250 is blocked.

More specifically, as shown in FIGS. 1 and 2, the auxiliary inlet openings 205A, 205B and 205C are disposed at three positions (locations) on the handle 27. The auxiliary inlet opening (first auxiliary inlet opening) 205A is a gap between the trigger 281 and a peripheral edge defining the through hole into which the trigger 281 is inserted. The first auxiliary inlet opening 205A communicatively connects an inside (internal space) and an outside of the handle 27. The auxiliary inlet opening (second auxiliary inlet opening) 205B is a gap between the lock-off button 284 and a peripheral edge defining the through hole into which the lock-off button 284 is inserted. The second auxiliary inlet opening 205B communicatively connects the inside and the outside of the handle 27. The auxiliary inlet opening (third auxiliary inlet opening) 205C is a gap between the lock-on button 287 and a peripheral edge defining the through hole into which the lock-on button 287 is inserted. The third auxiliary inlet opening 205C communicatively connects the inside and the outside of the handle 27.

As described above, in this embodiment, the handle 27 is formed integrally with the outer shell 24 of the body 20, and the internal space of the grip part 28 communicates with the first space 205. Thus, the air that has flowed into the grip part 28 through any one of the auxiliary inlet openings 205A, 205B and 205C flows through the internal space of the grip part 28 and flows into the first space, and then the air flows into the case 31 through the opening 218 of the fixing member 215 and the first opening 316 of the case 31.

Each of the auxiliary inlet openings 205A, 205B and 205C is a very small (minute) gap. The total area of the three auxiliary inlet openings 205A, 205B and 205C is extremely small compared to the total area of all of the inlet openings 250. Thus, while the inlet openings 250 are not blocked (closed), an extremely small amount of air flows into the grip part 28 through the auxiliary inlet openings 205A, 205B and 205C.

On the other hand, in a case in which the inlet openings 250 are partially or completely blocked (closed) (i.e., an amount of inlet air that flows in through the inlet openings 250 decreases), an amount of inlet air that flows into the grip part 28 through the auxiliary inlet openings 205A, 205B and 205C increases. Thus, in this embodiment, even if all of the inlet openings 250 are completely blocked, air can be introduced into the first space 205 through the auxiliary inlet openings 205A, 205B and 205C via the internal space of the grip part 28, so that the likelihood of excessive heat generation of the motor 33 can be reduced. An air-passing state of each of the auxiliary inlet openings 205A, 205B and 205C automatically changes, according to an air-passing state of the inlet openings 250, and therefore the user can utilize the air duster 1A without paying attention to the air-passing state of the inlet openings 250.

In a case where the motor 33 continues to be driven in a state in which the discharge opening 10 is completely blocked (closed) due to some reason, similar to the inlet openings 250, the motor 33 might generate excessive heat. Accordingly, an auxiliary outlet opening 206A is provided for allowing air to leak from the second space 206 even if the discharge opening 10 (the opening 80) is blocked (closed) in a state in which the nozzle 8 is mounted on the body 20.

More specifically, as shown in FIG. 5, when the nozzle 8 is mounted on the nozzle mounting part 231 of the air duster 1A, a rear end surface of the passage part 87 is slightly spaced apart forward from a front end surface of the nozzle mounting part 231. The auxiliary outlet opening 206A is formed as a gap between the rear end surface of the passage part 87 and the front end surface of the nozzle mounting part 231.

Similar to the auxiliary inlet openings 205A, 205B and 205C, the auxiliary outlet opening 206A is a very small (minute) gap. The area of the auxiliary outlet opening 206A is extremely small compared to the area of the opening 80 (the discharge opening 10) of the nozzle 8. Thus, while the opening 80 is not blocked, an extremely small amount of air leaks to the outside through the auxiliary outlet opening 206A. On the other hand, in a case where an amount of the air flowing out through the opening 80 decreases, an amount of the air leaking outside the nozzle 8 through the auxiliary outlet opening 206A increases. Thus, in this embodiment, even if the opening 80 (the discharge opening 10) is completely blocked (closed), the air is allowed to leak outside from the second space 206 through the auxiliary outlet opening 206A, so that the likelihood of excessive heat generation of the motor 33 can be reduced.

Figure 11:
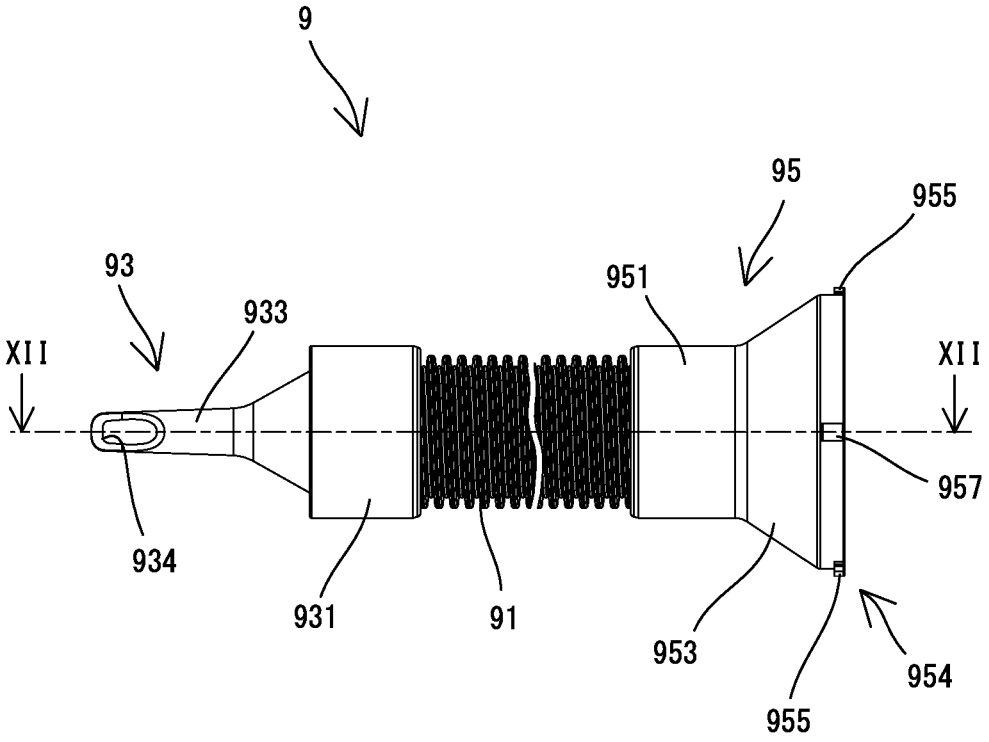
FIG. 11 is a side view of the suction attachment.
Figure 12:
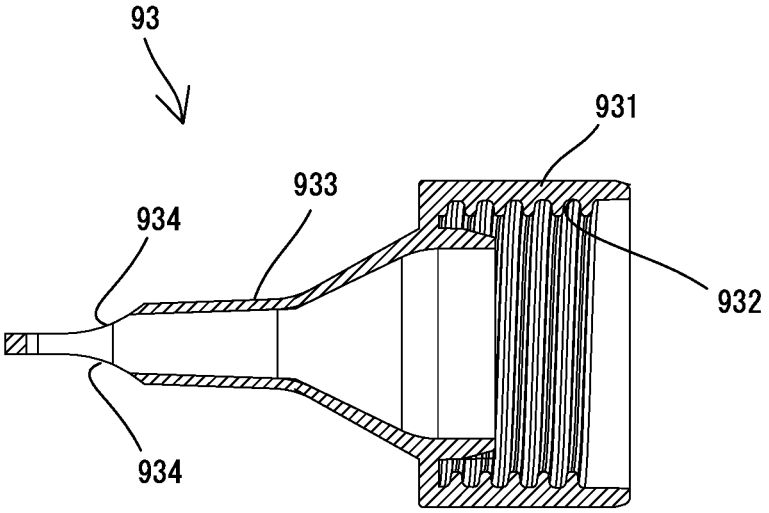
FIG. 12 is a sectional view taken along line in FIG. 11 wherein only a suction nozzle is shown.
Figure 13:
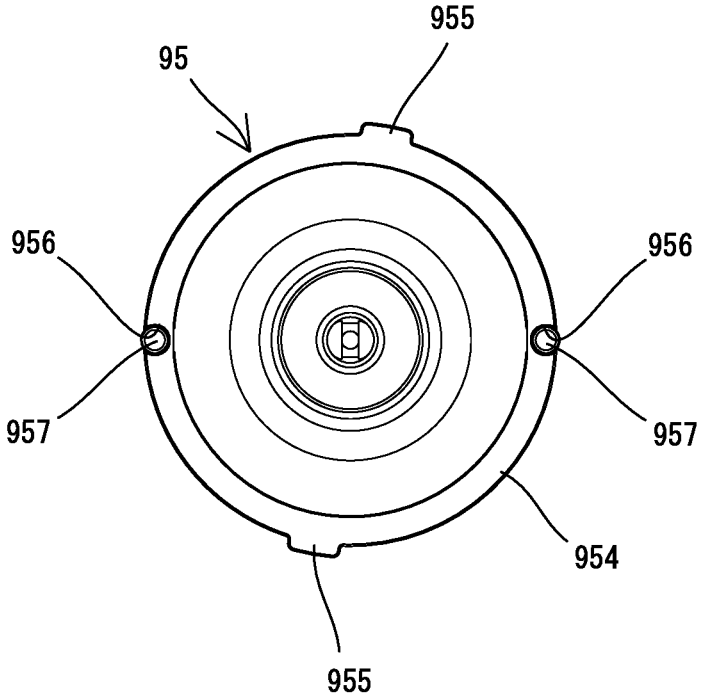
FIG. 13 is a plane view of the suction attachment as viewed from an opening side of a mount part.

The suction attachment 9 is now described. As described above, the suction attachment 9 is for use with the air duster 1A when the air duster 1A is used as a suction device. As shown in FIGS. 3 and 11, the suction attachment 9 includes a hose 91, a suction nozzle 93 removably connected to one end portion of the hose 91, and a mounting part 95 removably connected to the other end portion of the hose 91.

The hose 91 is an elongate flexible tubular member. In this embodiment, the hose 91 is made of synthetic resin (polymeric material). The hose 91 has a spiral bellows structure. The spiral bellows structure includes valleys (recesses) and ridges (projections) that project radially outward of the valleys, and the valleys and the ridges are alternately arranged in a spiral manner along a longitudinal direction of the hose 91. The bellows structure can suppress deformation of a sectional shape of the hose 91 when the hose 91 is bent, and thus can reduce the possibility that the air flow within the hose 91 is interrupted.

The length of the hose 91 is set such that, when the suction attachment 9 is mounted on (connected/attached to) the air duster 1A, a tip end portion (free end portion) of the suction nozzle 93 can be directed in the same direction (i.e., the forward direction) as a discharge direction of the air discharged from the discharge opening 10. Specifically, the length of the hose 91 of this embodiment is approximately 50 centimeters (cm).

As shown in FIGS. 3 and 11 to 13, the suction nozzle 93 as a whole is a single (integral) tubular member. The suction nozzle 93 includes a hose connection part 931 and a suction part 933 that extends from one end of the hose connection part 931 in an axial direction.

The hose connection part 931 has a generally hollow cylindrical shape. A spiral groove (screw groove) 932 that matches (conforms to) the bellows structure of the hose 91 is formed on an inner peripheral surface of the hose connection part 931. The hose connection part 931 is removably connected to a periphery of one end portion of the hose 91 by thread (screw) engagement. Thus, in this embodiment, the bellows structure achieves a function of suppressing deformation of the sectional shape of the hose 91 and a function of easily connecting the hose 91 and the suction nozzle 93.

The suction part 933 is an elongate tubular portion. Two suction openings 934 are formed at a tip end of the suction part 933. The suction nozzle 93 of this embodiment is a suction nozzle that is suitable for releasing air from an object that is used in an inflated state (for example, a swim tube (ring), a beach ball, an inflatable boat, an inflatable mattress, etc.). More specifically, the suction nozzle 93 is inserted into a protrusion (also referred to as an air plug) disposed on the object. A typical air plug has a valve (a protruding piece) at a proximal portion thereof. The valve is configured to open/close an opening of the proximal portion of the air plug.

A central portion of the suction part 933 in its longitudinal direction is formed such that the outer diameter and the inner diameter become slightly smaller toward the tip end. Further, a tip end portion of the suction part 933 is notched in an arc-like shape from both sides across an axis of the suction nozzle 93. Thus, two suction openings 934 are formed in the tip end portion of the suction part 933. When the central portion of the suction part 933 is pushed into the air plug of the object in close contact with each other, the tip end portion of the suction part 933 opens the valve in the proximal portion of the air plug. Consequently, the suction openings 934 are disposed inside the object, so that the air inside the object can be sucked. However, the suction part 933 is not limited to this example, and therefore the suction part 933 may have any shape as long as the suction part 933 is able to be fitted into the air plug in close contact with each other and the suction openings 934 are able to communicate with an internal space of the object.

The mounting part 95 as a whole is a single (integral) tubular member. The mounting part 95 includes a generally hollow cylindrical hose connection part 951 and a cover part 953 that extends from one end of the hose connection part 951 in an axial direction. Although not shown in detail, similar to the hose connection part 931 of the suction nozzle 93, a spiral groove (a screw groove) is formed on an inner peripheral surface of the hose connection part 951. The hose connection part 951 is removably connected to the other end portion of the hose 91 by thread (screw) engagement. The cover part 953 is configured to be mounted on (connected/attached to) the rear end portion 241 of the outer shell 24 so as to cover the opening 240. The cover part 953 has a tubular shape (a hollow truncated cone shape) of which the inner diameter and the outer diameter become larger in a direction away from the hose connection part 951. Similar to the inlet-side cover 25, a tip end portion (free end portion) of the cover part 953 is configured as an engagement part 954 that is engageable with the rear end portion 241, and has an engagement structure that is substantially the same as the inlet-side cover 25.

More specifically, the outer diameter of the engagement part 954 is substantially the same as the diameter of the opening 240 (the substantial inlet opening of the body 20) of the rear end portion 241 of the outer shell 24, and thus the engagement part 954 is configured to be fitted in the opening 240. Further, two protrusions 955, which are respectively engageable with the engagement grooves 247 of the rear end portion 241, protrude radially outward from an outer peripheral surface of the engagement part 954. Further, two recesses 956 are formed on an outer peripheral surface of the inlet-side cover 25. A cylindrical elastic pin 957 is fitted and held in each of the recesses 956. In this embodiment, the elastic pin 957 is made of rubber (i.e., the elastic pin 957 is a rubber pin). However, the elastic pin 957 may be made of other elastic material (for example, synthetic resin).

The user can easily mount (connect/attach) the suction attachment 9 on (to) the body 20, without using any device/tool, by engaging the protrusions 955 of the engagement part 954 with the engagement grooves 247 (see FIG. 7) of the rear end portion 241 of the body 20, respectively, similar to the procedure of mounting the inlet-side cover 25. Further, the user can easily remove the suction attachment 9 from the body 20 by disengaging the protrusions 955 from the corresponding engagement grooves 247. This configuration facilitates switching the function of the air duster 1A between a blower and a suction device.

In a case in which the air duster 1A is used as the suction device, the user mounts the suction attachment 9 on the rear end portion 241 of the body 20 and inserts the tip end portion of the suction part 933 into the air plug of an object to be deflated. When the user depresses the trigger 281 to drive the motor 33 and thereby rotate the fan 35, the air is sucked through the suction openings 934, and the air passes through the suction attachment 9 and flows into the body 20 of the air duster 1A through the opening 240 (the inlet opening) of the rear end portion 241. Thereafter, the air compressed by the fan 35 is discharged through the discharge opening 10.

As described above, the air duster 1A of this embodiment can be used as a suction device by selectively mounting the suction attachment 9 thereon. Therefore, the air duster 1A has superior usability. Further, in the air duster 1A, only one fan 35 is disposed to generate the flow of air discharged through the discharge opening 10 after cooling the motor 33. Thus, compared to a multiple-stage blower having a plurality of fans aligned in an extension direction of a rotational axis of the fans, the air duster 1A can be downsized in the rotational-axis-A1 direction of the fan 35.

In the suction attachment 9, the mounting part 95 to be mounted on the body 20 and the suction nozzle 93 having the suction openings 934 are connected to each other via the flexible hose 91. Thus, the user can change the position of the suction openings 934 relatively freely. The air duster 1A as a suction device thus has superior operability.

In particular, in this embodiment, the length of the hose 91 is set to allow the suction nozzle 93 (the suction openings 934) to be directed in the discharge direction of the air discharged from the discharge opening 10 of the body 20 (i.e., directed forward). Further, the grip part 28 of the air duster 1A extends from the body 20 in the up-down direction so as to intersect the discharge direction of the air from the discharge opening 10, and the trigger 281 is disposed on the front side of the grip part 28. Owing to this configuration, the user naturally manipulates the trigger 281 while looking to the front. Thus, the user can check both of a suction state and a discharge state of the air while operating the trigger 281. Considering the operability of the air duster 1A and the suitable length of the hose 91 that does not interfere with the operation, the length of the hose 91 is preferably within a range of 45 cm to 60 cm.

Various kinds of suction attachments 9 may be available for use with the air duster 1A, in addition to the suction attachment 9 described in this embodiment. These suction attachments 9 may have different lengths of the hoses 91 and/or different structures of the suction nozzles 93 (for example, the shape of the suction part 933), respectively. For example, a suction attachment 9 including a suction part 933 having a shape suitable for use with the air duster 1A as a cleaner may be available. The user can mount one of the suction attachments 9 that is suitable for the kind of the operation to be performed, and use the air duster 1A serving as a suction device.

Alternatively, various kinds of suction nozzles 93 having different shapes of the suction parts 933, respectively, may be available. As described above, the suction nozzle 93 is removably mounted on (connected (attached) to) the hose 91. Therefore, the user can replace only the suction nozzle 93, depending on the kind of the operation to be performed. Further, the mounting part 95 is also removably mounted on (connected (attached) to) the hose 91. Therefore, the user may replace only the hose 91 with another hose 91 having a different length, depending on the kind of operation to be performed.

When deflating the object using the air duster 1A with the suction attachment 9 of this embodiment mounted thereon, the suction openings 934 are completely disposed inside the object. Further, the user may cause the air duster 1A to suck the air with the trigger 281 being locked in the ON position using the lock-on button 287. In such a case, if the user leaves the air duster 1A still operating and thus the motor 33 continues to drive after the air has been completely released from the object, the air does not flow into the body 20 of the air duster 1A through the suction attachment 9 and the opening 240 (the inlet opening) of the rear end portion 241 any more. Consequently, the opening 240 is substantially blocked (closed). Even in such a case, the air duster 1A of this embodiment can introduce air into the first space 205 through the auxiliary inlet openings 205A, 205B and 205C, so that the possibility of the excessive heat generation of the motor 33 can be reduced.

Second Embodiment

An air duster 1B according to a second, non-limiting embodiment of the present disclosure is now described with reference to FIGS. 14 to 17. The air duster 1B of this embodiment has an auxiliary inlet opening 205D, which is different from the auxiliary inlet openings 205A to 205C of the air duster 1A of the first embodiment (see FIG. 2), and an auxiliary outlet opening 206B, which is different from the auxiliary outlet opening 206A (see FIG. 5). Other structures of the air duster 1B are substantially identical (or only slightly different in shape) to those in the air duster 1A. Therefore, in the following description, the structures of the air duster 1B that are substantially identical to those of the air duster 1A are given the same numerals and the illustration and the description thereof are omitted or simplified, and the structures of the air duster 1B that are different from those of the air duster 1A are mainly described.

Figure 14:
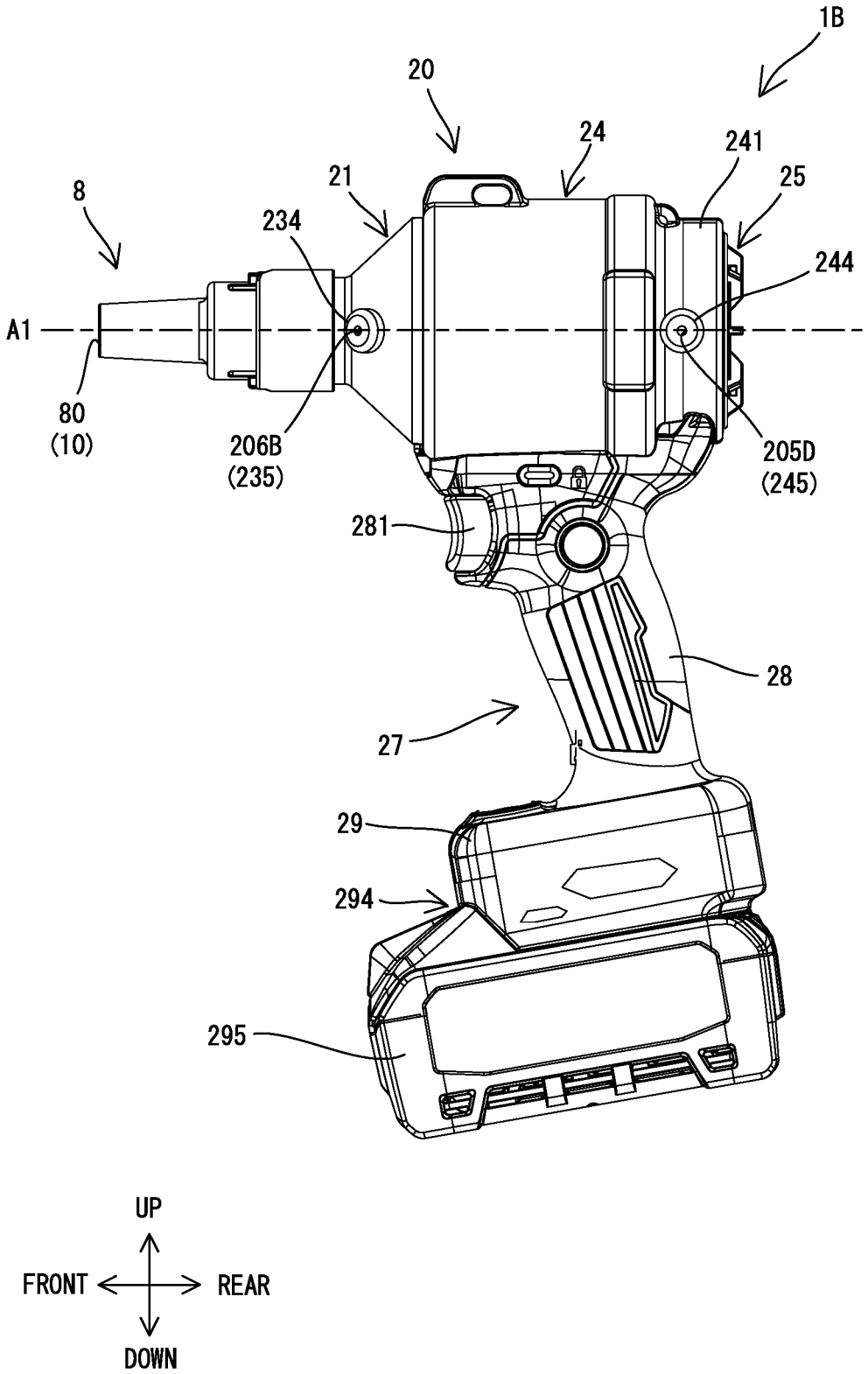
FIG. 14 is a left side view of another air duster.
Figure 15:
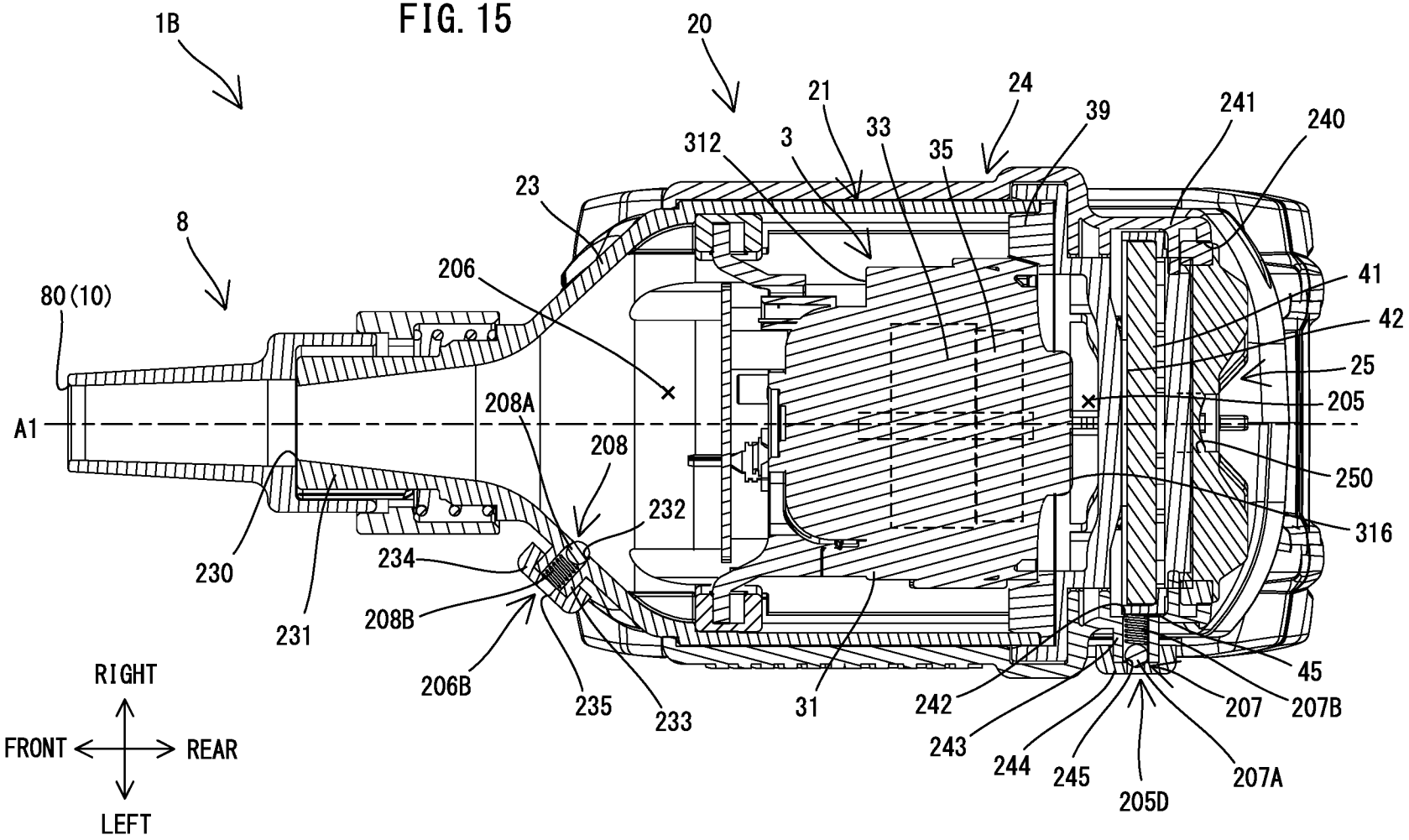
FIG. 15 is a sectional view taken along line XV-XV in FIG. 14, in which both of an auxiliary inlet opening and an auxiliary outlet opening are blocked.

As shown in FIGS. 14 and 15, the auxiliary inlet opening 205D and the auxiliary outlet opening 206B are provided in the body 20 of the air duster 1B of this embodiment. Further, a state of the auxiliary inlet opening 205D and a state of the auxiliary outlet opening 206B are selectively changed between an opened state and a closed state by a valve 207 and a valve 208, respectively.

More specifically, the auxiliary inlet opening 205D is formed at the rear end portion 241 of the outer shell 24 of the body 20. The auxiliary inlet opening 205D communicatively connects an inside (specifically, the first space 205) and an outside of the body 20. More specifically, a through hole 242 is formed in a left side portion of a peripheral wall that forms (defines) the rear end portion 241. Further, a cylindrical portion 243, which has an internal space communicating with the through hole 242, extends from an outer surface of the left side portion. The cylindrical portion 243 is covered by a bottomed cylindrical cap 244 from outside. A through hole 245 having a diameter that is smaller than the inner diameter of the cylindrical portion 243 is formed in a central portion of the cap 244. The auxiliary inlet opening 205D is formed by the through hole 242, the internal space of the cylindrical portion 243, and the through hole 245.

The valve 207 is formed by a ball 207A and a biasing spring 207B. The ball 207A has a diameter that is slightly smaller than the inner diameter of the cylindrical portion 243. The ball 207A is movable within the cylindrical portion 243. The biasing spring 207B is a compression coil spring and is arranged between the ball 207A and a left wall of the filter holder 45 in a slightly compressed manner. Thus, the ball 207A is normally biased leftward by the biasing spring 207B to block (close) the through hole 245 from the inside of the cap 244. Thus, the auxiliary inlet opening 205D is normally blocked (closed) by the valve 207.

Figure 16:
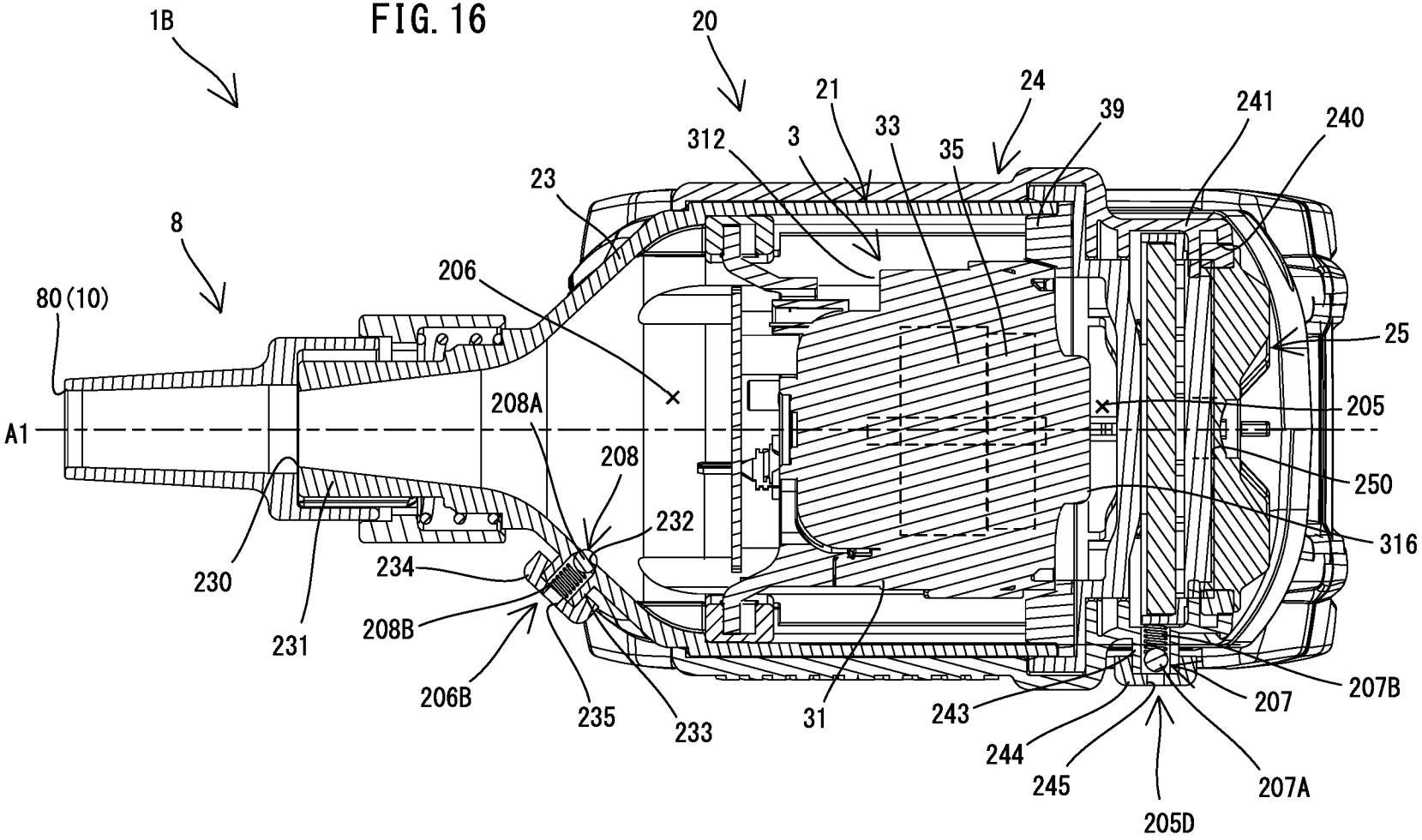
FIG. 16 is a sectional view corresponding to FIG. 15, in which only the auxiliary inlet opening is opened.

In a case where the inlet opening 250 (see FIG. 4) is completely blocked (i.e., when the flow of air from the outside of the body 20 into the first space 205 is interrupted), the pressure in the first space 205 decreases. In a case where the pressure in the first space 205 decreases to a specified pressure, as shown in FIG. 16, the ball 207A is pulled inward within the cylindrical portion 243 against the biasing force of the biasing spring 207B. The ball 207A is thus slightly spaced apart from the cap 244, so that the through hole 245 is opened. Accordingly, outside air is introduced into the first space 205 through the auxiliary inlet opening 205D. In a case in which the suction attachment 9 (see FIG. 3), instead of the inlet-side cover 25, is mounted on the body 20 and the suction openings 934 are blocked (closed), the flow of air into the first space 205 through the opening 240, which is the substantial inlet opening of the body 20, is interrupted. Also in this case, when the pressure in the first space 205 decreases to the specified pressure, the auxiliary inlet opening 205D is opened.

As described above, in this embodiment, in response to interruption of the flow of air into the first space 205 through the inlet opening 250 (or the opening 240), the valve 207 is automatically activated to change the state of the auxiliary inlet opening 205D from the closed state to the open state. Consequently, the possibility of excessive heat generation of the motor 33 can be reduced. Further, the valve 207 can reliably change the air-passing state of the auxiliary inlet opening 205D.

The auxiliary outlet opening 206B is formed at the nozzle part 23 of the tubular housing 21 of the body 20. The auxiliary outlet opening 206B communicatively connects the inside (specifically, the second space 206) and the outside of the body 20. More specifically, a through hole 232 is formed in a left side portion of a peripheral wall that forms (defines) the nozzle part 23. A ball 208A, which will be described later, is configured to be partially fitted in the through hole 232 while partially protruding inward of the peripheral wall. A cylindrical portion 233, which has an internal space communicating with the through hole 232, extends from an outer surface of the peripheral wall. The cylindrical portion 233 is covered by a bottomed cylindrical cap 234 from outside. A through hole 235 having a diameter that is smaller than the inner diameter of the cylindrical portion 233 is formed in a central portion of the cap 234. The auxiliary outlet opening 206B is formed by the through hole 232, the internal space of the cylindrical portion 233, and the through hole 235.

The valve 208 is formed by the ball 208A and a biasing spring 208B. The ball 208A has a diameter that is slightly smaller than the inner diameter of the cylindrical portion 233. The ball 208A is movable within the cylindrical portion 233. The biasing spring 208B is a compression coil spring and is arranged between the ball 208A and the cap 234 in a slightly compressed manner. Thus, the ball 208A is normally biased toward the peripheral wall of the nozzle part 23 by the biasing spring 208B, and fitted in the through hole 232 to block (close) the through hole 232. Thus, the auxiliary outlet opening 206B is normally blocked (closed) by the valve 208.

Figure 17:
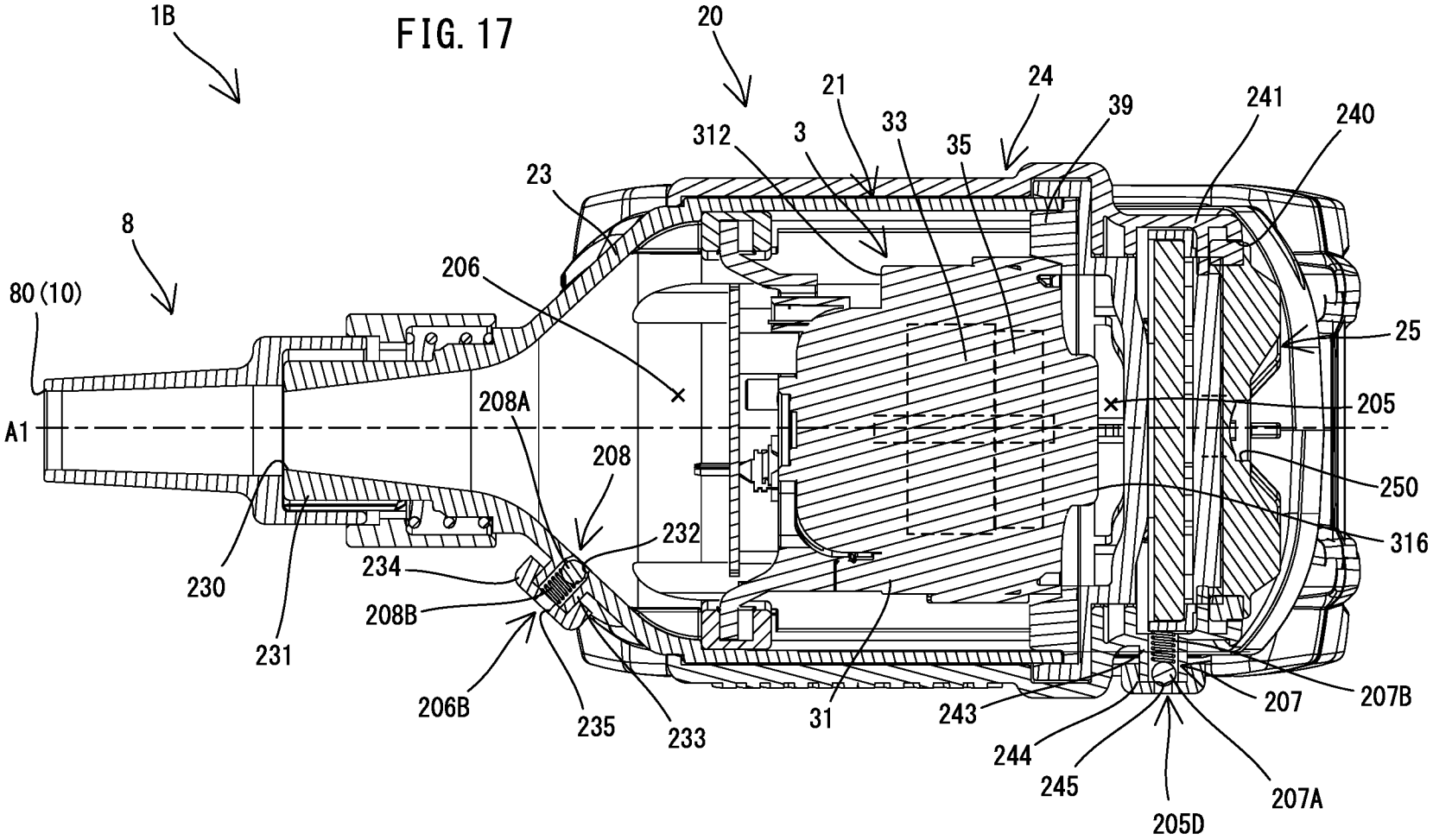
FIG. 17 is a sectional view corresponding to FIG. 15, in which only the auxiliary outlet opening is opened.

In a case where the discharge opening 10 (the opening 230 of the nozzle part 23 or the opening 80 of the nozzle 8) is completely blocked (i.e., the flow of air from the second space 206 to the outside of the body 20 is interrupted), the pressure in the second space 206 increases. In a case where the pressure in the second space 206 increases to a specified pressure, as shown in FIG. 17, the ball 208A is pushed into the cylindrical portion 233 against the biasing force of the biasing spring 208B. The ball 208A thus opens the through hole 232. Accordingly, the air leaks out of the second space 206 through the auxiliary outlet opening 206B.

As described above, in this embodiment, in response to interruption of the flow of air out of the second space 206 through the discharge opening 10 (the opening 230 of the nozzle part 23 or the opening 80 of the nozzle 8), the valve 208 is automatically activated to change the state of the auxiliary outlet opening 206B from the closed state to the open state. Consequently, the possibility of excessive heat generation of the motor 33 can be reduced. Further, the valve 208 can reliably change the air-passing state of the auxiliary outlet opening 206B.

Correspondences between the features of the above-described embodiments and the features of the present disclosure or the invention are as follows. However, the features of the embodiments are merely exemplary, and do not limit the features of the present disclosure or the present invention.

Each of the air dusters 1A and 1B is an example of the "blower". The body 20 is an example of the "body". The inlet opening 250 (the opening 240) is an example of the "main inlet opening". The discharge opening 10 (the opening 230) is an example of the "discharge opening". The motor assembly 3 is an example of the "motor assembly". Each of the auxiliary inlet openings 205A, 205B, 205C and 205D is an example of the "auxiliary inlet opening". The case 31, the first opening 316 and the second opening 312 are examples of the "case", the "first opening" and the "second opening", respectively. The motor 33 and the fan 35 are examples of the "motor" and the "fan", respectively. The first space 205 is an example of the "first space".

The seal ring 39 is an example of the "seal member". The tubular housing 21 is an example of the "motor housing". The outer shell 24 is an example of the "outer shell". The rear end and the front end of the tubular housing 21 are examples of the "first end" and the "second end", respectively. The second space 206 is an example of the "second space". The left shell 201 and the right shell 202 are an example of the "two halves". The nozzle part 23 is an example of the "tapered part". The fixing member 215 and the opening (the communication opening) 218 are examples of the "fixing member" and the "communication opening", respectively. Each of the first filter 41 and the second filter 42 is an example of the "filter". The handle 27 is an example of the "handle". The valve 207 is an example of the "valve".

The above-described embodiments are merely exemplary embodiments of the disclosure, and the blower according to the present disclosure is not limited to each of the air dusters 1A and 1B of the above-described embodiments. For example, the following modifications may be made. Further, at least one of these modifications may be employed in combination with at least one of the air dusters 1A and 1B of the above-described embodiments and the claimed features.

The structures (the shapes, components and connection mode between the components) of the body 20 and the handle 27 are not limited to those of the above-described embodiment and may be appropriately changed.

For example, the body 20 may be formed as a single-layered housing, instead of the two-layered housing that includes the tubular housing 21 and the outer shell 24. The single-layered housing may have an internal space that is partitioned (divided) into a suction-side space and a discharge-side space relative to the fan 35 and isolated from each other by a seal member such as the seal ring 39. Further, the tubular housing 21 may be formed by connecting two halves divided in a direction that is orthogonal to the rotational axis A1 (for example, in the left-right direction or in the up-down direction) or by connecting a plurality of members divided in the front-rear direction. A portion of the body 20 and the handle 27 need not be formed integrally with each other, like the outer shell 24 of the above-described embodiments. Further, instead of the handle 27, a portion of the body 20 may include a grip part to be gripped by the user.

The inlet-side cover 25 may be substantially irremovably connected to the outer shell 24 (the rear end portion 241). In this case, each of the air dusters 1A and 1B may have a sole function as a blower. Alternatively, the mounting part 95 of the suction attachment 9 may be removably mounted on (connected/attached to) the periphery of the rear end portion 241 such that the mounting part 95 covers the inlet-side cover 25. Further, the inlet-side cover 25 may be removably screwed with the outer shell 24, or may be removably fixed to the outer shell 24 using separate screws. In this case, the structure of the rear end portion 241 of the body 20 and the structure of the mounting part 95 (the engagement part 954) of the suction attachment 9 may be also changed. Further, the size, shape, numbers and arrangement of the inlet opening(s) 250 of the inlet-side cover 25 may be appropriately changed from those in the above-described embodiment.

The auxiliary inlet opening that is configured to introduce air into the first space 205 is not limited to the auxiliary inlet openings 205A, 205B, 205C and 205D of the above-described embodiments. For example, the auxiliary inlet opening may be formed as a very small (minute) through hole on (in) the handle 27 or the peripheral wall of the rear end portion 241 of the outer shell 24, irrespective of the trigger 281, the lock-off button 284 and the lock-on button 287. Similarly, the auxiliary outlet opening that is configured to discharge air from the second space 206 is not limited to the auxiliary outlet openings 206A and 206B of the above-described embodiments. For example, the auxiliary outlet opening may be formed as a very small (minute) through hole on (in) the housing part 22. Further, similar to the second embodiment, the auxiliary inlet opening and the auxiliary outlet opening of the above-described modification may be opened and closed by a valve.

The structure of the motor assembly 3 may be appropriately changed. The motor 33 may be a brushed motor instead of the brushless motor. The fan 35 may be fixed to the motor shaft 335 not at the side of the inlet opening 250 relative to the motor body 330 but at the side of the discharge opening 10 relative to the motor body 330 within the case 31. A centrifugal fan (in particular, a backward curved fan (also referred to as a turbo fan)) is preferably employed as the fan 35. However, a mixed flow fan may be also employed. The arrangements of the first opening 316 and the second opening 312 of the case 31 may be appropriately changed in response to or regardless of the change relating to the fan 35. The support member 37 may be omitted from the motor assembly 3 and the circuit board 38 may be arranged at a position different from that in the above-described embodiment.

The motor assembly 3 need not necessarily be connected to the body 20 (the tubular housing 21) via the seal ring 39 and the elastic covers 373. For example, the motor assembly 3 may be supported by the seal ring 39 and a plurality of ribs disposed in the tubular housing 21. Alternatively, the motor assembly 3 may be supported by only a plurality of the ribs disposed in the tubular housing 21. In this case, the seal ring 39 may have only one function of isolating the first space 205, which communicates with the inlet opening 250 and the first opening 316 of the case 10, and the second space, which communicates with the second opening 312 of the case 31 and the discharge opening 10. Thus, for example, instead of the single cylindrical seal ring 39, one or more elastic bodies that have the above-described function may be disposed between the body 20 and the case 31. The one or more elastic bodies may be preferably made of rubber or elastomer.

The mesh sizes of the first filter 41 and the second filter 42 may be substantially the same to each other. Alternatively, the mesh size of the first filter 41 may be larger than the mesh size of the second filter 42. At least one of the first filter 41 and the second filter 42 may be omitted. In a case in which only one filter is employed, it is preferable that the filter is removable from the body 20.

The power source of each of the air dusters 1A and 1B is not limited to the rechargeable battery 295, but may be a disposable battery or an external AC power source. A rechargeable battery may be incorporated in each of the air dusters 1A and 1B.

Further, in view of the nature of the present invention, the above-described embodiments and the modifications thereof, the following Aspects A1 to A10 are provided. Any one or more of the following Aspects A1 to A10 can be employed in combination with any one of the above-described embodiments, the modifications thereof, and the invention described in each claim.

(Aspect A1)

The auxiliary inlet opening is spaced apart from the at least one main inlet opening.

(Aspect A2)

The auxiliary inlet opening is formed around an operation member that is inserted into a through hole formed on the handle and that is movable in response to depressing manipulation of the operation member performed by a user.

(Aspect A3)

The operation member is a trigger for activating the motor, or a button for locking the trigger in a specified position.

(Aspect A4)

The auxiliary inlet opening is formed on (in) the outer shell.

(Aspect A5)

The seal member has a tubular shape, the seal member is at least partially arranged between an inner surface of the motor housing and an outer surface of the case in a radial direction relative to a rotational axis of the fan, and the seal member seals a gap between the inner surface of the motor housing and the outer surface of the case.

(Aspect A6)

The body further comprises an inlet-side cover that has the inlet opening and is configured to be removably mounted on the outer shell, and the outer shell is configured such that a suction attachment having a suction opening is removably mountable thereon, in place of the inlet-side cover.

(Aspect A7)

The blower further comprises an auxiliary outlet opening that is configured to discharge air from the second space to an outside of the body.

(Aspect A8)

The auxiliary outlet opening is configured such that an air-passing state of the auxiliary outlet opening is changed in response to an air-passing state of the discharge opening.

(Aspect A9)

The auxiliary outlet opening is configured such that an amount of air passing the auxiliary outlet opening increases in response to decrease in an amount of air passing the discharge opening.

(Aspect A10)

The blower further comprises a valve that is configured to selectively change a state of the auxiliary outlet opening between an open state and a closed state.

Further, in order to provide an improved blower on which a suction attachment is mountable, the following Aspects B1 to B13 are provided. Any one of the following Aspects B1 to B13 can be employed alone or two or more of them can be employed in combination with each other. Alternatively, any one or more of the following Aspects B1 to B13 can be employed in combination with at least one of the air dusters 1A and 1B of the above-described embodiments, the above-described modifications, the above-described Aspects A1 to A10 and the claimed features.

(Aspect B1)

A blower comprising:

a body that has an inlet opening and a discharge opening;

a motor that is housed in the body; and a single fan that is housed in the body and is configured to rotate in response to driving of the motor to generate a flow of air that is sucked through the inlet opening, passes through the motor and is discharged through the discharge opening, wherein the body comprises a first mounting part on which a suction attachment is selectively removably mountable.

The blower of this Aspect allows the suction attachment to be selectively mounted thereon (connected/attached thereto), so that the blower can be used as a suction device and thus the blower has superior usability. Further, the blower of this Aspect includes only one fan that generates the flow of air discharged through the discharge opening after cooling the motor. Thus, compared to a multiple-stage blower having a plurality of fans aligned in an extension direction of a rotational axis of the fans, the blower can be downsized in the extension direction of the rotational axis.

(Aspect B2)

The blower as defined in Aspect B1, wherein:

the first mounting part has an opening that communicatively connects an inside and an outside of the body, a cover that has the inlet opening and that is configured to cover the opening of the first mounting part is removably mounted on the first mounting part, and the suction attachment is mountable on the first mounting part in place of the cover.

According to this Aspect, the function of the blower can be easily switched between a blower and a suction device.

(Aspect B3)

The blower as defined in Aspect B2, further comprising a filter arranged between an opening of the first mounting part and the motor within the body.

According to this Aspect, the filter can capture foreign matters (for example, dust), which enter the body together with the air, so that the possibility that the motor is adversely affected by the foreign matters can be effectively reduced. Further, the user can clean and/or replace the filter after removing the cover or the suction attachment from the body, and thus the blower can achieve superior usability.

(Aspect B4)

The blower as defined in any one of Aspects B1 to B3, wherein the suction attachment is removable from and mountable on the first mounting part without using a separate device/tool.

According to this Aspect, the suction attachment can be especially easily removed/mounted, so that the usability is further improved.

(Aspect B5)

A suction attachment that is removably mountable on the blower as defined in any one of Aspects B1 to B4, the suction attachment comprising:

a tubular flexible member;

a second mounting part that is configured to be removably mounted on the first mounting part and that is connected to one end portion of the flexible member; and a suction part that has a suction opening and that is connected to the other end portion of the flexible member.

The suction attachment of this Aspect can be mounted on the blower to cause the blower to function as a suction device. Further, the second mounting part to be mounted on the first mounting part of the blower and the suction part having the suction opening are connected via the tubular flexible member, so that the user can change the position of the suction opening relatively freely and thus the suction device can achieve superior operability.

(Aspect B6)

The suction attachment as defined in Aspect B5, wherein the flexible member has a length that allows the suction part to be directed in a discharge direction of the air discharged from the discharge opening of the blower.

According to this Aspect, the user can check both of a suction state and a discharge state of the air, so that the operability can be further improved.

(Aspect B7)

The suction attachment as defined in Aspect B5 or B6, wherein the flexible member has a deformation-suppressing mechanism that is configured to suppress deformation of a sectional shape of the flexible member when the flexible member is bent.

According to this Aspect, the possibility that the flexible member is crushed and thus the air flow within the flexible member is interrupted can be reduced.

(Aspect B8)

The suction attachment as defined in Aspect B7, wherein the deformation-suppressing mechanism is a bellows structure.

The bellows structure herein refers to a structure that includes valleys (recesses) and ridges (projections) that project radially outward of the valleys, wherein the valleys and the ridges are alternately arranged along a longitudinal direction of the flexible member. According to this Aspect, the possibility that the air flow is interrupted can be effectively reduced utilizing a simple structure of the flexible member.

(Aspect B9)

The suction attachment as defined in any one of Aspects B5 to B8, wherein the suction part is removably connectable to the flexible member.

According to this Aspect, the user can replace the suction part, depending on the kind of the operation to be performed with the suction attachment, so that the usability can be further improved.

(Aspect B10)

The suction attachment as defined in Aspect B9, wherein:

the flexible member is a hose having a spiral bellows structure, and the suction part is configured to be connected to the bellows structure of the hose by thread (screw) engagement.

According to this Aspect, a simple structure of the suction attachment can realize both of a function of suppressing the deformation of the sectional shape of the flexible member and a function of facilitating removing/connecting of the suction part from/to the flexible member.

(Aspect B11)

The first mounting part is arranged on a suction side of the fan.

(Aspect B12)

The blower further comprises a grip part that extends from the body in a direction that intersects the rotational axis of the fan, the extension direction of the rotational axis of the fan defines a front-rear direction of the blower, the discharge opening is configured to discharge air forward from the blower, and a trigger that is configured to be manually depressed by a user is disposed on a front portion of the grip part in the front-rear direction.

(Aspect B13)

The suction part is configured to be fitted into an air plug for releasing air of an inflatable object, such that the suction part is in close contact with the air plug in a state in which the inlet opening is disposed within the inflatable object.

Correspondences between the features of the above-described embodiments and the features of the Aspects B1 to B13 are as follows. The features of the above-described embodiments are merely exemplary and do not limit the features of the Aspects B1 to B13.

Each of the air dusters 1A and 1B is an example of the "blower". The body 20 is an example of the "body". The inlet opening 250 is an example of the "inlet opening". The discharge opening 10 (the opening 230) is an example of the "discharge opening". The motor 33 is an example of the "motor". The fan 35 is an example of the "fan". The rear end portion 241 of the outer shell 24 is an example of the "first mounting part". The suction attachment 9 is an example of the "suction attachment". The opening 240 is an example of the "opening of the first mounting part". The inlet-side cover 25 is an example of the "cover". Each of the first filter 41 and the second filter 42 is an example of the "filter". The hose 91 is an example of the "tubular flexible member". The mounting part 95 (the engagement part 954) is an example of the "second mounting part". The suction nozzle 93 (the suction part 933) is an example of the "suction part". The suction opening 934 is an example of the "suction opening". The bellows structure of the hose 91 is an example of the "deformation-suppressing mechanism".

The above-described embodiments are merely exemplary embodiments of the disclosure, and the blower according to the Aspect B1 to B13 is not limited to the air dusters 1A and 1B of the above-described embodiments. For example, the following modifications may be made. Further, any one or more of these modifications may be employed in combination with at least one of the air dusters 1A and 1B of the above-described embodiments, the above-described modifications, the above-described Aspects and the claimed features.

The structures (the shapes, components and connection mode between the components) of the body 20 and the handle 27 are not limited to those of the above-described embodiment and may be appropriately changed.

For example, the body 20 may be formed as a single-layered housing, instead of the two-layered housing that includes the tubular housing 21 and the outer shell 24. Further, the tubular housing 21 may be formed by connecting two halves divided in a direction that is orthogonal to the rotational axis A1 (for example, the left-right direction or the up-down direction) or by connecting a plurality of members divided in the front-rear direction. A portion of the body 20 and the handle 27 need not be formed integrally with each other like the outer shell 24 of the above-described embodiment. Further, instead of the handle 27, a portion of the body 20 may include a grip part to be gripped by the user.

The size, shape, number and arrangement of the inlet opening(s) 250 of the inlet-side cover 25 may be appropriately changed from those in the above-described embodiments. The inlet-side cover 25 may be substantially irremovably mounted on (connected/attached to) the outer shell 24 (the rear end portion 241). In this case, the mounting part 95 of the suction attachment 9 may be removably mounted on (connected/attached to) the periphery of the rear end portion 241 so as to cover the inlet-side cover 25.

The engagement structure between the inlet-side cover 25 and the rear end portion 241 of the body 20 may be appropriately changed. In response to this modification, the structure of the mounting part 95 (the engagement part 954) of the suction attachment 9 may also be changed. For example, one of a male thread and a female thread may be formed on the rear end portion 241 of the body 20 and the other one of the male thread and the female thread may be formed on the mounting part 95 of the suction attachment 9. Alternatively, one of a recess and an engagement piece with a claw (projection) that is elastically deformable may be disposed on the rear end portion 241 of the body 20 and the other one of the recess and the engagement piece with the claw may be disposed on the mounting part 95 of the suction attachment 9. Further, the mounting part 95 of the suction attachment 9 may be removably connected to the rear end portion 241 of the body 20 using separate screws.

In addition or in the alternative to the above-described modifications, for example, the following modification(s) may be applied to the suction attachment 9. For example, the hose 91 need not have the bellows structure. The hose 91 may be made of flexible synthetic resin to have a substantially uniform diameter. The bellows structure may have a normal bellows structure, instead of the spiral bellow structure, such that valleys (recesses) and ridges (projections) are simply alternately arranged along the longitudinal direction of the hose 91. Further, as the structure that suppresses the deformation of the sectional shape of the hose 91, instead of the bellows structure, for example, a wire may be spirally attached around a wall that defines the hose 91. At least one of the suction nozzle 93 and the mounting part 95 may be substantially irremovably connected to the hose 91.

The auxiliary inlet opening for introducing air into the first space 205 and the auxiliary outlet opening for discharging air from the second space 206 may be disposed at positions different from those in the above-described embodiments, or may be omitted.

The motor 33 may be a brushed motor, instead of the brushless motor. Further, the motor assembly 3 need not necessarily be supported by the body 20 (the tubular housing 21) via elastic members such as the seal ring 39 and the elastic covers 373. For example, the motor assembly 3 may be positioned and supported by a plurality of ribs disposed in the tubular housing 21. In addition, the motor 33 need not form an assembly together with the case 31, the bearings 32 and the fan 35. In such a modification, the structure for supporting the motor 33 may be appropriately changed. For example, the case 31 that houses the motor body 330 may be omitted, and the motor shaft 335 may be rotatably supported by bearings supported by the body 20.

The fan 35 may be fixed to the motor shaft 335 not at the side of the inlet opening 250 relative to the motor body 330 but at the side of the discharge opening 10 relative to the motor body 330. A centrifugal fan (in particular, a backward curved fan (also referred to as a turbo fan)) is preferably employed as the fan 35. However, a mixed flow fan may be also employed.

The mesh sizes of the first filter 41 and the second filter 42 may be substantially the same to each other. Alternatively, the mesh size of the first filter 41 may be larger than the mesh size of the second filter 42. At least one of the first filter 41 and the second filter 42 may be omitted. In a case in which only one filter is employed, it is preferable that the filter is removable from the body 20.

The power source of each of the air dusters 1A and 1B is not limited to the rechargeable battery 295, but may be a disposable battery or an external AC power source. A rechargeable battery may be incorporated in each of the air dusters 1A and 1B.

DESCRIPTION OF THE REFERENCE NUMERALS

1A, 1B: air duster, 10: discharge opening, 3: motor assembly, 8: nozzle, 9: suction attachment, 20: body, 201: left shell, 202: right shell, 205: first space, 205A, 205B, 205C, 205D: auxiliary inlet opening, 206: second space, 206A, 206B: auxiliary outlet opening, 207: valve, 207A: ball, 207B: biasing spring, 208: valve, 208A: ball, 208B: biasing spring, 21: tubular housing, 215: fixing member, 216: peripheral wall part, 217: pressing part, 218: opening, 22: housing part, 23: nozzle part, 230: opening, 231: nozzle mounting part, 232: through hole, 233: cylindrical portion, 234: cap, 235: through hole, 238: locking mechanism, 24: outer shell, 240: opening, 241: rear end portion, 242: through hole, 243: cylindrical portion, 244: cap, 245: through hole, 246: protrusion, 247: engagement groove, 248: wall, 25: inlet-side cover, 250: inlet opening, 251: protrusion, 253: recess, 254: elastic pin, 27: handle, 28: grip part, 281: trigger, 282: switch, 284: lock-off button, 287: lock-on button, 29: controller-housing part, 291: controller, 294: battery mounting part, 295: battery, 31: case, 311: peripheral wall part, 312: second opening, 313: bearing support part, 315: cover part, 316: first opening, 32: bearing, 33: motor, 330: motor body, 331: stator, 333: rotor, 335: motor shaft, 35: fan, 37: support member, 371: first arm, 372: second arm, 373: elastic cover, 38: circuit board, 39: seal ring, 391: outer flange, 393: inner flange, 41: first filter, 42: second filter, 45: filter holder, 80: opening, 81: mounting part, 87: passage part, 91: hose, 93: suction nozzle, 931: hose connection part, 932: groove, 933: suction part, 934: suction opening, 95: mounting part, 951: hose connection part, 953: cover part, 954: engagement part, 955: protrusion, 956: recess, 957: elastic pin, A1: rotational axis

What is claimed is:

1. A blower comprising:

a body that has a main inlet opening and a discharge opening;

a motor assembly that is housed in the body;

an auxiliary inlet opening; and a seal member, wherein:

the motor assembly comprises:

(i) a case that has a first opening and a second opening;

(ii) a motor that is housed within the case; and (iii) a fan that is configured to rotate in response to driving of the motor to generate a flow of air passing the main inlet opening, the first opening, the motor, the second opening and the discharge opening in this order, the seal member is configured to divide a space formed between the body and the case of the motor assembly into (i) a first space that communicates with the main inlet opening of the body and the first opening of the case and (ii) a second space isolated from the first space by the seal member and communicating with the second opening of the case and the discharge opening, and the auxiliary inlet opening is configured to introduce the air from an outside of the body into the first space.

2. The blower as defined in claim 1, further comprising a handle configured to be held by a user, wherein:

at least a portion of the body is formed integrally with the handle, and the handle has the auxiliary inlet opening.

3. The blower as defined in claim 1, wherein the auxiliary inlet opening is configured such that an air-passing state of the auxiliary inlet opening changes according to an air-passing state of the main inlet opening.

4. The blower as defined in claim 3, wherein the auxiliary inlet opening is configured such that an amount of air passing through the auxiliary inlet opening increases in response to decrease in an amount of air passing through the main inlet opening.

5. The blower as defined in claim 3, further comprising a valve that is configured to selectively change a state of the auxiliary inlet opening between an open state and a closed state.

6. The blower as defined in claim 3, further comprising an auxiliary outlet opening that is configured to discharge air from the second space to an outside of the body, wherein the outlet opening is configured such that an air-passing state of the auxiliary outlet opening changes according to an air-passing state of the discharge opening.

7. The blower as defined in claim 6, wherein the auxiliary outlet opening is configured such that an amount of air passing the auxiliary outlet opening increases in response to decrease in an amount of air passing the discharge opening.

8. The blower as defined in claim 6, further comprising a valve that is configured to selectively change a state of the auxiliary outlet opening between an open state and a closed state.

9. A blower comprising:

a body that has a main inlet opening and a discharge opening;

a motor assembly that is housed in the body;

an auxiliary inlet opening; and a seal member, wherein:

the motor assembly comprises:

(i) a case that has a first opening and a second opening;

(ii) a motor that is housed within the case; and (iii) a fan that is configured to rotate in response to driving of the motor to generate a flow of air passing the main inlet opening, the first opening, the motor, the second opening and the discharge opening in this order, a first space that communicates with the main inlet opening of the body and the first opening of the case is formed within the body, the auxiliary inlet opening is configured to introduce the air from an outside of the body into the first space, the body comprises:

(i) a motor housing that at least partially houses the motor assembly; and (ii) an outer shell that partially houses the motor housing, a first end of the motor housing is inside the outer shell, a second end of the motor housing is outside the outer shell and defines the discharge opening, and the seal member is configured to isolate the first space formed inside the outer shell and a second space formed inside the motor housing from each other, the second space communicating with the second opening of the case and the discharge opening.

10. The blower as defined in claim 9, wherein:

the motor housing is a single member having a tubular shape, and the outer shell is formed by two halves connected with each other, the two halves being divided in a direction that intersects a rotational axis of the fan.

11. The blower as defined in claim 10, wherein the motor housing includes a tapered part having an inner diameter decreasing toward the discharge opening.

12. The blower as defined in claim 9, wherein the outer shell has the auxiliary inlet opening.

13. The blower as defined in claim 9, further comprising a fixing member that is mounted on the motor housing to cover an opening at the first end of the motor housing and that has a communication opening, wherein the seal member is fixedly held by the fixing member.

14. The blower as defined in claim 13, further comprising a filter arranged between the main inlet opening and the communication opening.

15. The blower as defined in claim 9, further comprising a handle configured to be held by a user, wherein:

at least a portion of the body is formed integrally with the handle, and the handle has the auxiliary inlet opening.

16. The blower as defined in claim 9, wherein the auxiliary inlet opening is configured such that an air-passing state of the auxiliary inlet opening changes according to an air-passing state of the main inlet opening.

17. The blower as defined in claim 16, wherein the auxiliary inlet opening is configured such that an amount of air passing through the auxiliary inlet opening increases in response to decrease in an amount of air passing through the main inlet opening.

18. The blower as defined in claim 16, further comprising an auxiliary outlet opening that is configured to discharge air from the second space to an outside of the body, wherein the outlet opening is configured such that an air-passing state of the auxiliary outlet opening changes according to an air-passing state of the discharge opening.

19. The blower as defined in claim 18, wherein the auxiliary outlet opening is configured such that an amount of air passing the auxiliary outlet opening increases in response to decrease in an amount of air passing the discharge opening.

* * * * *